US007669507B2

(12) United States Patent
Furusawa et al.

(10) Patent No.: US 7,669,507 B2
(45) Date of Patent: Mar. 2, 2010

(54) TIGHTENING TOOL

(75) Inventors: Masanori Furusawa, Anjo (JP); Yoshinori Shibata, Anjo (JP); Yukihiko Yamada, Anjo (JP)

(73) Assignee: Makita Corporation, Anjo-shi (JP)

( * ) Notice: Subject to any disclaimer, the term of this patent is extended or adjusted under 35 U.S.C. 154(b) by 0 days.

(21) Appl. No.: 11/254,739

(22) Filed: Oct. 21, 2005

(65) Prior Publication Data

US 2006/0086215 A1 Apr. 27, 2006

(30) Foreign Application Priority Data

Oct. 21, 2004 (JP) ..... 2004-307465

(51) Int. Cl.
*B25B 23/157* (2006.01)

(52) U.S. Cl. ..... 81/475

(58) Field of Classification Search ..... 81/473–475; 173/176, 178

See application file for complete search history.

(56) References Cited

U.S. PATENT DOCUMENTS 4,573,370 A * 3/1986 Clemens ..... 74/337.5
4,655,103 A 4/1987 Schreiber et al.
4,947,714 A 8/1990 Fluri
5,134,909 A * 8/1992 Sasaki ..... 81/473
5,156,244 A 10/1992 Pyles et al.
5,209,308 A * 5/1993 Sasaki ..... 173/178
5,372,206 A * 12/1994 Sasaki et al. ..... 173/178
5,538,089 A * 7/1996 Sanford ..... 173/178
6,173,792 B1 1/2001 Hald
6,851,343 B2 * 2/2005 Sasaki ..... 81/475

FOREIGN PATENT DOCUMENTS

JP A-06-114752 4/1994
JP A-2000-108045 4/2000
JP A-2004-314206 11/2004

* cited by examiner

*Primary Examiner*—Hadi Shakeri
(74) *Attorney, Agent, or Firm*—Oliff & Berridge, PLC

(57) ABSTRACT

It is an object of the present invention to provide a technique for appropriately providing not only for normal rotation but for reverse rotation in a tightening tool having a clutch.

Representative tightening tool according to the invention comprises a body, a driving motor housed in the body, a driving-side clutch element, an auxiliary clutch element, a driven-side clutch element, a driven shaft and a tool bit. During normal rotation of the driving motor, the driven-side clutch element is caused to move in the axial direction by application of a pressing force of the user to the body to engage with the driving-side clutch element. During reverse rotation of the driving motor, the driving-side clutch element and the auxiliary clutch element are caused to move relatively with respect to each other in the axial direction by rotating torque of the driving-side clutch element and the driving-side clutch element or the auxiliary clutch element engages with the driven-side clutch element.

11 Claims, 20 Drawing Sheets

Unloaded condition

Clutch on

Working operation

Clutch off

Unloaded condition

Clutch on

TIGHTENING TOOL

BACKGROUND OF THE INVENTION

1. Field of the Invention

The present invention relates to a tightening tool such as an electric screwdriver used for screw-tightening operation and more particularly, to a tightening tool having a clutch which appropriately provides not only for normal rotation but for reverse rotation.

2. Description of the Related Art

An example of a known electric screwdriver is disclosed in Japanese patent publication No. 3-5952, in which a clutch is used to connect a tool bit and a driving motor for transmitting the rotating torque. According to this technique, when the tightening tool or screw is tightened to a predetermined depth with respect to the workpiece, the clutch is promptly disengaged to stop transmission of the rotating torque according to the tightening depth.

According to the known screwdriver, the clutch is engaged when the user applies a pressing force on the body of the screwdriver, so that the torque of the driving motor is transmitted to the tool bit. Further, the clutch is disengaged in relation to the tightening depth of the screw. Therefore, when a pressing force of the user is not applied on the body, it may be difficult to keep the clutch in the engaged state in the screwdriver. As a result, screw-loosing operation by rotating the driving motor in a reverse direction may be basically impossible. In this respect, further improvement is required.

SUMMARY OF THE INVENTION

Accordingly, it is an object of the present invention to provide a technique for appropriately providing not only for normal screw-tightening rotation but for reverse rotation in a tightening tool.

Above-mentioned object is achieved by providing a representative tightening tool according to the invention. The tightening tool comprises a body, a driving motor housed in the body, a driving-side clutch element, an auxiliary clutch element, a driven-side clutch element, a driven shaft and a tool bit.

The driving-side clutch element receives torque of the driving motor both in normal rotation and in reverse rotation. The auxiliary clutch element is rotated by the driving-side clutch element and can move in the axial direction with respect to the driving-side clutch element. The driven-side clutch element releasably engages with either one or both of the driving-side clutch element and the auxiliary clutch element. The driven-side clutch element receives the torque of the driving-side clutch element and rotates. The driven shaft is driven by rotation of the driving-side clutch element. The tool bit is connected to the driven shaft to perform a tightening operation and a loosening operation via rotating torque of the driven shaft.

The driven shaft moves in the axial direction with respect to the body together with the driving-side clutch element. During normal rotation of the driving motor, the driven-side clutch element is caused to move in the axial direction by application of a pressing force of the user to the body to engage with the driving-side clutch element. Thus, the torque of the driving motor in the normal direction is transmitted to the tool bit to perform a tightening operation.

Further, during reverse rotation of the driving motor, the driving-side clutch element and the auxiliary clutch element are caused to move relatively with respect to each other in the axial direction by rotating torque of the driving-side clutch element and the driving-side clutch element or the auxiliary clutch element engages with the driven-side clutch element. Thus, the torque of the driving motor in the reverse direction is transmitted to the tool bit to perform a loosening operation.

According to the invention, power transmission via clutch mechanism not only for normal rotation but for reverse rotation in a tightening tool can be provided.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved tightening tools and method for using such tightening tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment

Figure 1:
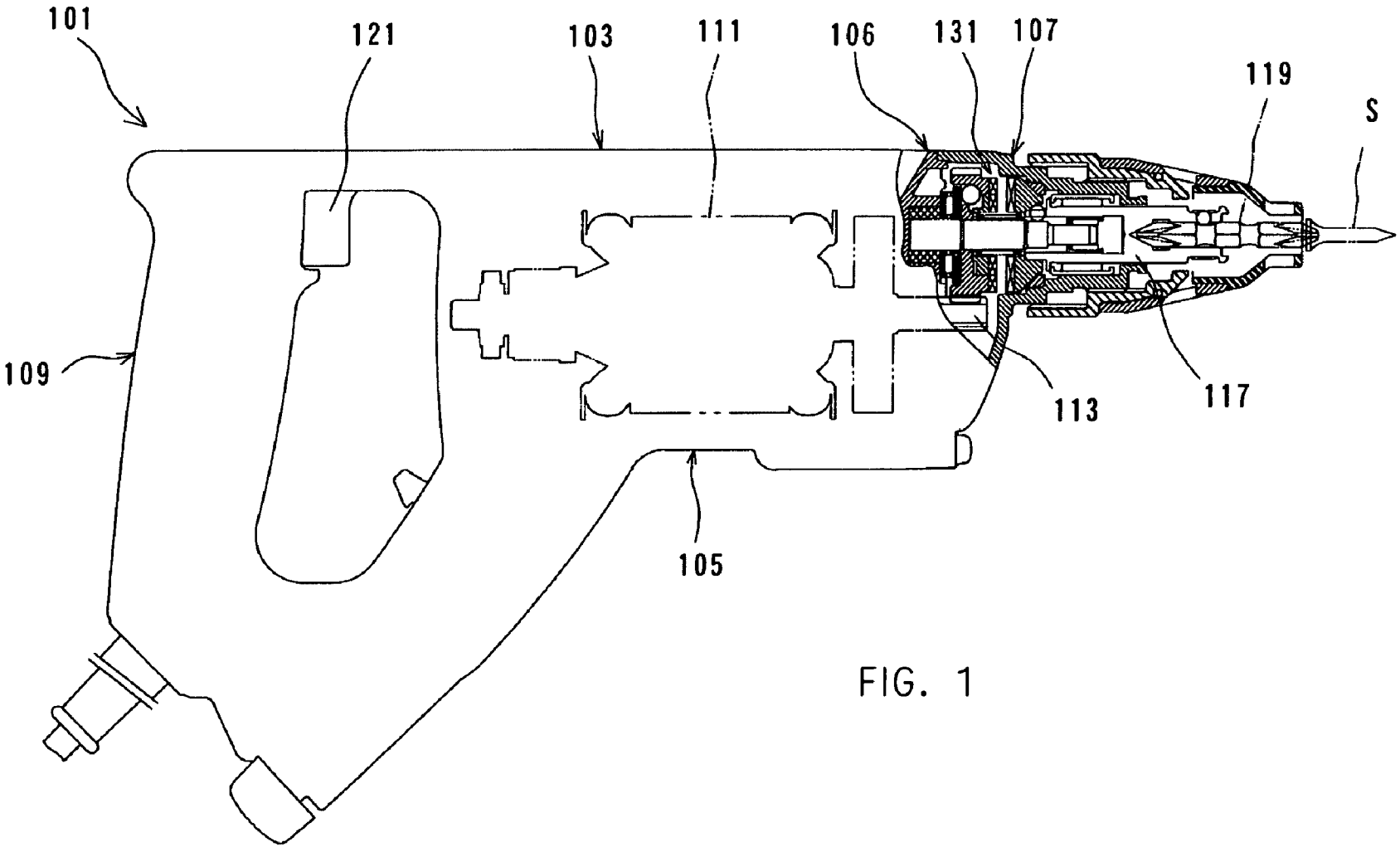
FIG. 1 is a side view, partly in section, schematically showing an entire screw driver according to a first embodiment of the invention.

A first embodiment of the present invention will now be described with reference to FIGS. 1 to 16. FIG. 1 shows an entire view of an electric screwdriver 101 as a representative example of the power tool according to the present invention. The screwdriver 101 of this embodiment includes a body 103, a driver bit 119 and a handgrip 109. The driver bit 119 is detachably coupled to the tip end region of the body 103 via a spindle 117. The handgrip 109 is connected to the body 103 on the side opposite to the driver bit 119. The spindle 117 is a feature that corresponds to the "driven shaft" according to the present invention. The driver bit 119 is a feature that corresponds to the "tool bit" according to the present invention. In the present embodiment, for the sake of convenience of explanation, the side of the driver bit 119 is taken as the front side and the side of the handgrip 109 as the rear side.

The body 103 includes a motor housing 105 and a clutch housing 107. The motor housing 103 houses a driving motor 111. The clutch housing 107 houses a clutch mechanism 131 that transmits the rotating output of the motor 111 to the spindle 117 or stops the transmission of the rotating output. The direction of rotation of the driving motor 111 can be selected between normal and reverse directions by operating a rotation selection switch (rotation selecting member) which is not shown.

In this embodiment, an operation of tightening a screw S on a workpiece W (see FIG. 3) is performed by normal rotation of the motor 111, while an operation of loosening the screw S is performed by reverse rotation of the motor 111. In the following description, rotation of the clutch mechanism 131 as driven by the torque of the motor 111 in the normal direction is referred to as normal rotation or rotation in the normal direction, while rotation of the clutch mechanism 131 as driven by the torque of the motor 111 in the reverse direction is referred to as reverse rotation or rotation in the reverse direction.

Figure 2:
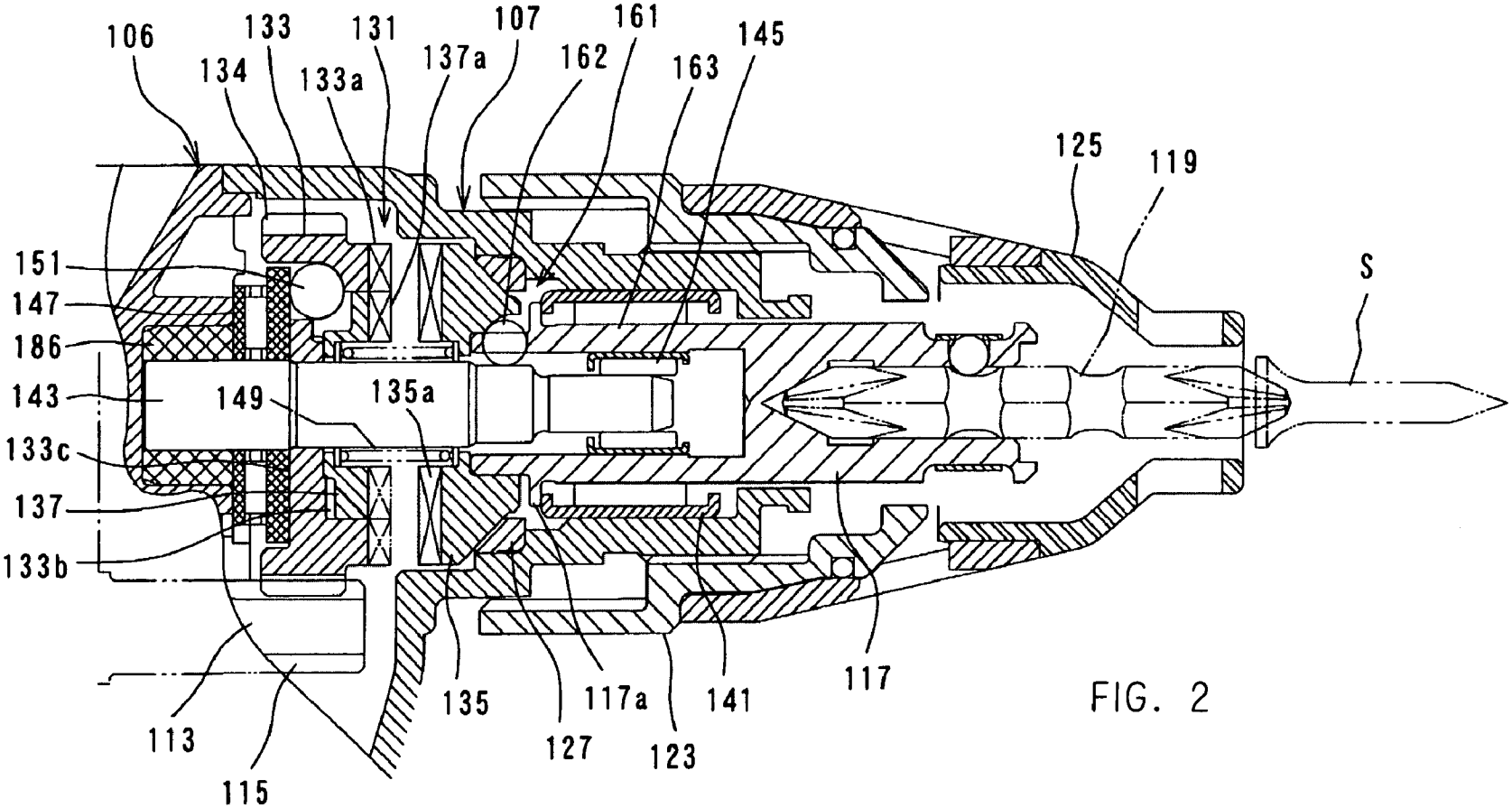
FIG. 2 is a sectional view showing a driving mechanism of a driver bit.

FIG. 2 shows a detailed construction of the clutch mechanism 131. The clutch mechanism 131 includes a driving-side clutch member 133 that is driven by the motor 111, a clutch cam 137 that is disposed on the side of the driving-side clutch member 133 and a spindle-side clutch member 135 that is mounted on the spindle 117, all of which are disposed coaxially. The driving-side clutch member 133, the spindle-side clutch member 135 and the clutch cam 137 are features that correspond to the "driving-side clutch element", "driven-side clutch element" and "auxiliary clutch element", respectively, according to the present invention.

In using the screwdriver 101 to tighten the screw S by driving the motor 111 in the normal direction, when the driver bit 119 supported by the spindle 117 is pressed against the workpiece W via the screw S, clutch teeth 135*a* of the spindle-side clutch member 135 engage with clutch teeth 137*a* of the clutch cam 137 and clutch teeth 133*a* of the driving-side clutch member 133. Further, when such pressing of the driver bit 119 is stopped, the above-mentioned engagement is released by the biasing force of an elastic member in the form of a compression coil spring 149. In the following description, the state in which the driver bit 119 is pressed against the workpiece W via the screw S and a force is acting upon the spindle 117 in the direction that pushes (retracts) the spindle 117 into the body 103 will be referred to as "loaded conditions", while the state in which such force is not acting upon the spindle 117 will be referred to as "unloaded conditions". Further, the clutch teeth 133*a* of the driving-side clutch member 133, the clutch teeth 135*a* of the spindle-side clutch member 135 and the clutch teeth 137*a* of the clutch cam 137 will be referred to as driving-side clutch teeth 133*a*, driven-side clutch teeth 135*a* and auxiliary clutch teeth 137*a*, respectively.

Construction of each component of the clutch mechanism 131 will now be explained in detail. The spindle 117 is rotatably and axially moveably supported by the clutch housing 107 via a bearing 141. The forward movement of the spindle 117 is restricted by contact between a flange 117*a* of the spindle 117 and an axial end surface of the bearing 141. The spindle-side clutch member 135 is fitted on an axially rear end portion of the spindle 117. The spindle-side clutch member 135 can rotate together with the spindle 117 and move in the axial direction at higher speed than the spindle 117, via an engagement speedup mechanism 161 which will be described below.

The driving-side clutch member 133 is press-fitted onto a support shaft 143 and has a driving gear 134 on the outer periphery. The driving gear 134 engages with a pinion gear 115 on the output shaft 113 of the motor 111. One end of the support shaft 143 is inserted into the bore of a cylindrical portion 163 formed in the rear end portion of the spindle 117 and is supported by the cylindrical portion 163 via a bearing 145 such that the support shaft 143 can move in the axial direction with respect to the spindle 117. Further, the other end of the support shaft 143 is supported by a fan housing 106 via a support ring 186 such that the support shaft 143 can move in the axial direction. The fan housing 106 is disposed and joined between the motor housing 105 and the clutch housing 107. A thrust bearing 147 is disposed on the rear side (the left side as viewed in FIG. 2) of the driving-side clutch member 133. The thrust bearing 147 receives a thrust load that is applied to the driving-side clutch member 133 via the compression coil spring 149 during operation of tightening the screw S. The axial movement of the thrust bearing 147 is restricted by a steel ball 151 which will be described below.

A circular recess 133*b* is centrally formed in the front side of the driving-side clutch member 133 and has a larger diameter than the support shaft 143. The ring-shaped clutch cam 137 is fitted in the circular recess 133*b*. The driving-side clutch member 133 and the clutch cam 137 are disposed like coaxially arranged outer and inner rings. The rear surface of the clutch cam 137 contacts the bottom of the circular recess 133*b*. Further, the front surface of the clutch cam 137 is flush with or protrudes forward from the front surface of the driving-side clutch member 133. The driving-side clutch member 133 and the clutch cam 137 are opposed to the spindle-side clutch member 135. The compression coil spring 149 is disposed between the opposed surfaces or between the front-side inner peripheral region of the clutch cam 137 and the rear-side inner peripheral region of the spindle-side clutch member 135. The compression coil spring 149 urges the driving-side clutch member 133 and clutch cam 137 and the spindle-side clutch member 135 away from each other. A rear surface 133*c* of the driving-side clutch member 133 is pushed against the thrust bearing 147 by the compression coil spring 149.

As shown in FIGS. 7 to 10, a plurality of (three in this embodiment) driving-side clutch teeth 133*a* are formed on the front surface of the driving-side clutch member 133 at equal intervals (of 120°) with respect to each other in the circumferential direction. Similarly, three auxiliary clutch teeth 137*a* are formed on the front surface of the clutch cam 137 at equal intervals of 120° with respect to each other in the circumferential direction. Further, three driven-side clutch teeth 135*a* are formed on the rear surface of the spindle-side clutch member 135 at equal intervals (of 120°) with respect to each other in the circumferential direction. The driven-side clutch teeth 135*a* has a radial length long enough to engage with the driving-side clutch teeth 133*a* and the auxiliary clutch teeth 137*a*. The clutch teeth 133*a*, 135*a* and 137*a* are shown in FIGS. 7(A), 8(A), 9(A) and 10(A) in developed view and in FIGS. 7(C), 8(C), 9(C) and 10(C) in plan view. Normally or under unloaded conditions in which the driver bit 119 is not pressed against the screw S, the driving-side clutch member 133 and clutch cam 137 and the spindle-side clutch member 135 are held in the disengaged position (as shown in FIG. 2) in which they are disengaged (separated) from each other by the biasing force of the compression coil spring 149. The driving-side clutch teeth 133*a*, the driven-side clutch teeth 135*a* and the auxiliary clutch teeth 137*a* form the "driving-side clutch part", "driven-side clutch part" and "auxiliary clutch part", respectively.

Under loaded conditions in which the driver bit 119 is pressed against the workpiece W via the screw S, the spindle 117 retracts together with the driver bit 119 with respect to the body 103 of the screwdriver 101. The spindle-side clutch member 135 is then caused to move toward the driving-side clutch member 133. Thus, the driven-side clutch teeth 135*a* engage with the driving-side clutch teeth 133*a* and the auxiliary clutch teeth 137*a*. At this time, a phase difference of an angle □(see FIG. 7(C)) is provided in the rotational direction between the driving-side clutch teeth 133*a* and the auxiliary clutch teeth 137*a*. Specifically, the auxiliary clutch teeth 137*a* are located forward of the driving-side clutch teeth 133*a* in the direction of normal rotation when the driving-side clutch member 133 is caused to rotate by the torque of the driving motor 111 in the normal direction. Thus, the driven-side clutch teeth 135*a* of the spindle-side clutch member 135 engage with the auxiliary clutch teeth 137*a* before the driving-side clutch teeth 133*a*. Further, the mating surfaces of the clutch teeth 133*a* and the auxiliary clutch teeth 137*a* with the driven-side clutch teeth 135*a* are shaped such that they engage in surface contact. Specifically, the driving-side clutch teeth 133*a*, the driven-side clutch teeth 135*a* and the auxiliary clutch teeth 137*a* have flat end surfaces in the circumferential direction which are parallel to each other in the axial direction. In other words, each of the clutch teeth has flat mating surfaces that extend in directions crossing the circumferential direction. Further, the auxiliary clutch teeth 137*a* are flush with or protrude forward from the front surface of the driving-side clutch teeth 133*a*.

As shown in FIGS. 7 to 10, when the driving-side clutch member 133 is caused to rotate in the normal direction, the driving-side clutch member 133 and the clutch cam 137 are connected to each other such that they are allowed to move with respect to each other within a predetermined range in the circumferential direction via a plurality of (three in this embodiment) steel balls 151. The connection by the steel balls 151 is shown in FIGS. 7(A), 8(A), 9(A) and 10(A) in developed view and in FIGS. 7(B), 8(B), 9(B) and 10(B) in plan view. The steel balls 151 are fitted in lead grooves 153. The lead grooves 153 are formed in the driving-side clutch member 133 at equal intervals (of 120°) with respect to each other in the circumferential direction and have a predetermined length in the circumferential direction. The lead grooves 153 are open on the rear side of the driving-side clutch member 133. The inside of a groove bottom 153*a* of each of the lead grooves 153 is continuous with the above-mentioned circular recess 133*b*. Therefore, parts of the steel balls 151 in the lead grooves 153 face the rear surface of the clutch cam 137 and engage with concave cam faces 155 that are formed in the clutch cam 137 at intervals of 120° with respect to each other in the circumferential direction. Thus, when the driving-side clutch member 133 is caused to rotate in the normal direction by the driving motor 111, the driving-side clutch member 133 and the clutch cam 137 are allowed to move with respect to each other in the circumferential direction via the steel balls 151 within a predetermined range that is defined by the circumferential length of the lead grooves 153.

The surface of the groove bottom 153*a* of each of the lead grooves 153 is inclined downward in the direction of normal rotation of the driving-side clutch member 133. Under unloaded conditions (when the motor is stopped), each of the steel balls 151 is located in the deepest region of the groove bottom 153*a* of the associated lead groove 153 and is flush with the rear surface (the contact surface with the thrust bearing 147) of the driving-side clutch member 133. In this state, as mentioned above, the phase difference of the angle α is provided in the direction of normal rotation between the driving-side clutch teeth 133*a* of the driving-side clutch member 133 and the auxiliary clutch teeth 137*a* of the clutch cam 137. This state is maintained under unloaded conditions in which the driver bit 119 is not pressed against the workpiece W.

When the clutch cam 137 is caused to move in a direction (that delays its rotation) opposite to the normal rotation, each of the cam faces 155 of the clutch cam 137 pushes the associated steel ball 151 toward a shallower part of the groove bottom 153*a* of the associated lead groove 153. Thus, parts of the steel balls 151 protrude from the rear surface 133*c* of the driving-side clutch member 133 toward the thrust bearing 147. As a result, the driving-side clutch member 133 moves forward (toward the spindle-side clutch member 135) against the biasing force of the compression coil spring 149. Further, when the auxiliary clutch teeth 137*a* of the clutch cam 137 engage with the driven-side clutch teeth 135*a* of the spindle-side clutch member 135, the clutch cam 137 receives a load in the circumferential direction from the spindle-side clutch member 135, which causes the clutch cam 137 to move in a direction that delays its rotation with respect to the driving-side clutch member 133. Thus, the steel balls 151 form axial displacement means for displaying the driving-side clutch member 133 in the axial direction in cooperation with the compression coil spring 149. When the clutch cam 137 is caused to move in a direction that delays its rotation with respect to the driving-side clutch member 133, each of the steel balls 151 is caused to move toward a shallower part of the groove bottom 153*a* within the associated lead groove 153. At this time, the phase difference of an angle α between the driving-side clutch teeth 133*a* and the auxiliary clutch teeth 137*a* becomes zero, and the driving-side clutch teeth 133*a* engage with the driven-side clutch teeth 135*a*. In this respect, it may be constructed such that only the driving-side clutch teeth 133*a* engage with the driven-side clutch teeth 135*a* and transmit the power, or alternatively that both the driving-side clutch teeth 133*a* and the auxiliary clutch teeth 137*a* engage with the driven-side clutch teeth 135*a* and transmit the power. The latter is more suitable in terms of power transmission.

The above-mentioned connection between the driving-side clutch member 133 and the clutch cam 137 in the circumferential direction by using the steel balls 151 is made with respect to the direction of normal rotation when the motor 111 is driven in the normal direction. Connection between the driving-side clutch member 133 and the clutch cam 137 with respect to the direction of reverse rotation when the motor 111 is driven in the reverse direction will be described below.

The driver bit 119 is detachably coupled to the tip end portion (front end portion) of the spindle 117. Further, an adjuster sleeve 123 is fitted on the front end portion of the clutch housing 107 and can adjust its axial position. A stopper sleeve 125 is detachably mounted on the front end of the adjuster sleeve 123. The amount of protrusion of the driver bit 119 from the tip end of the stopper sleeve 125 is adjusted by adjusting the axial position of the adjuster sleeve 123. In this manner, the tightening depth of the screw S can be adjusted.

Figure 11:
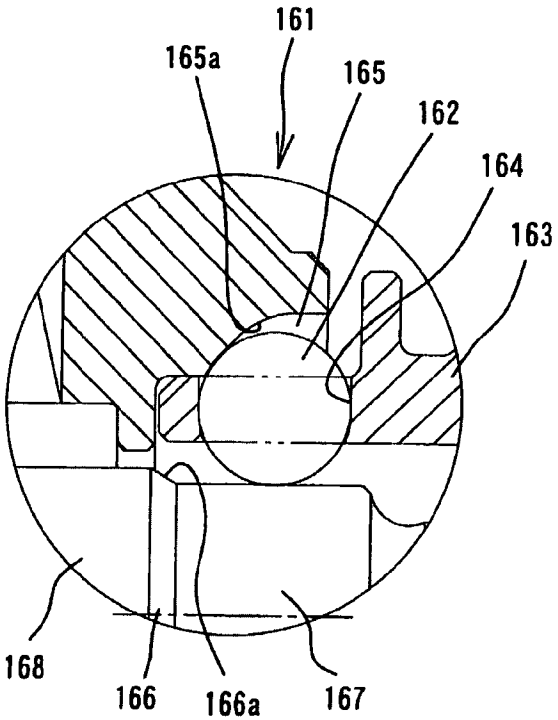
FIG. 11 shows the operation of an engagement speedup mechanism of the clutch mechanism under unloaded conditions.
Figure 11:
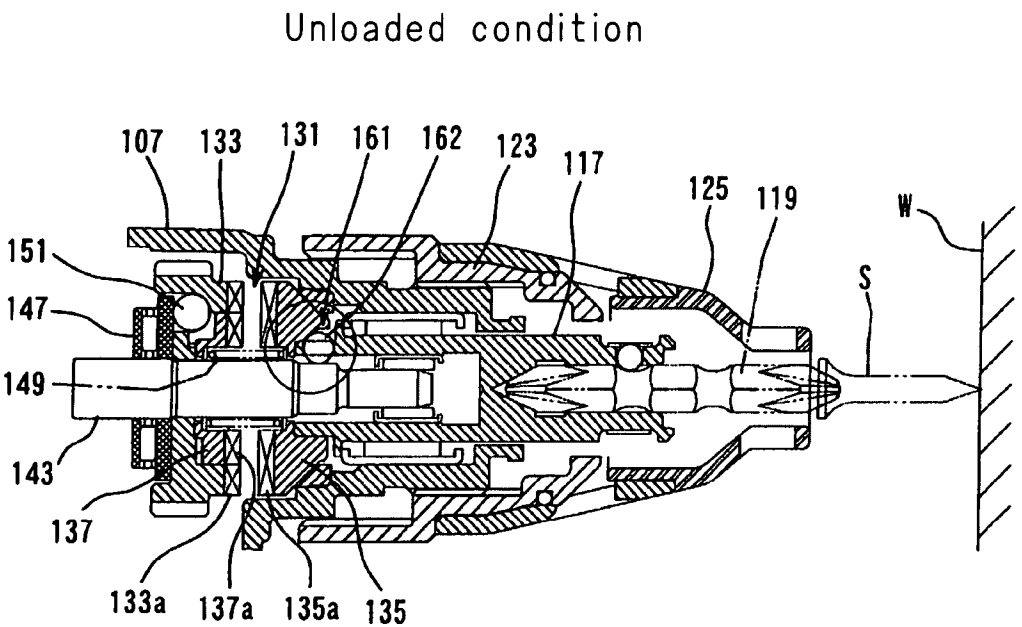
Figure 12:
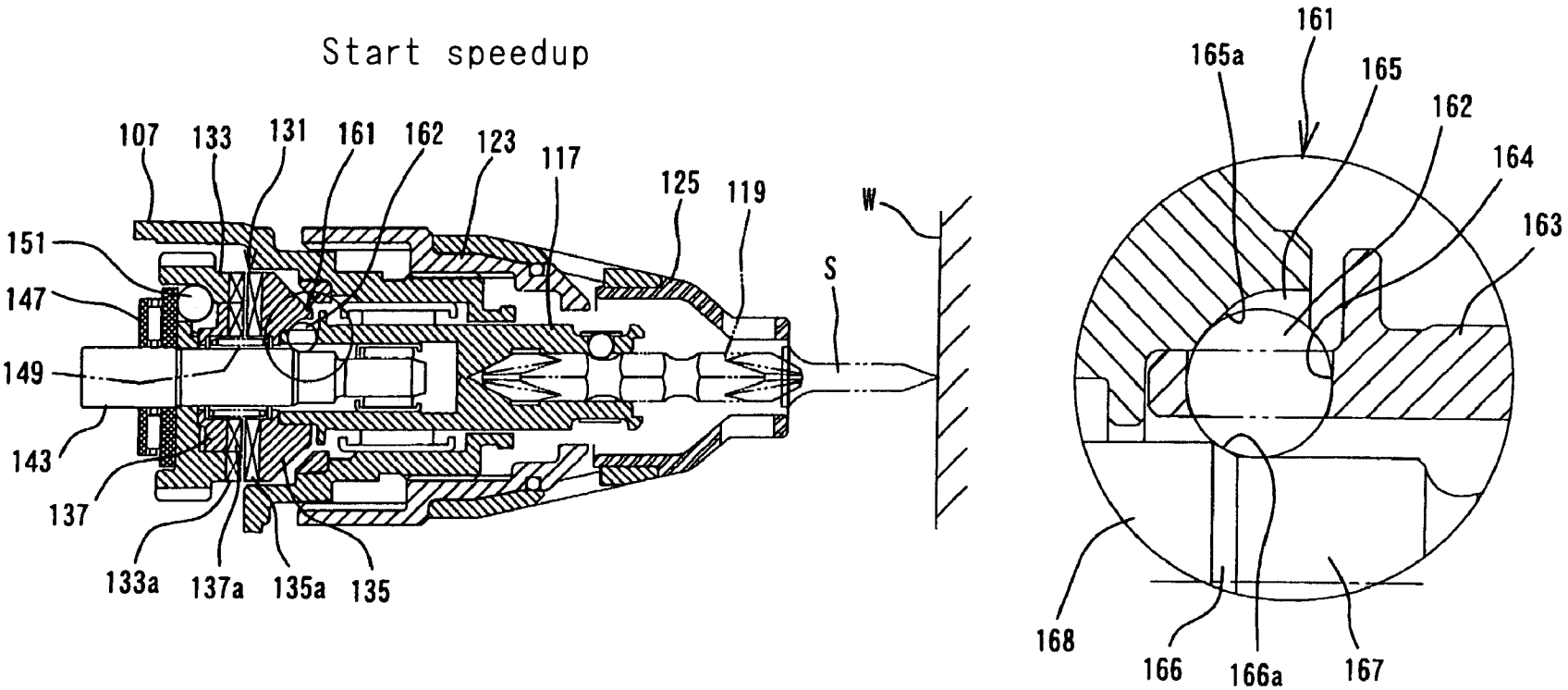
FIG. 12 shows the operation of the engagement speedup mechanism of the clutch mechanism at the time of starting speedup.
Figure 13:
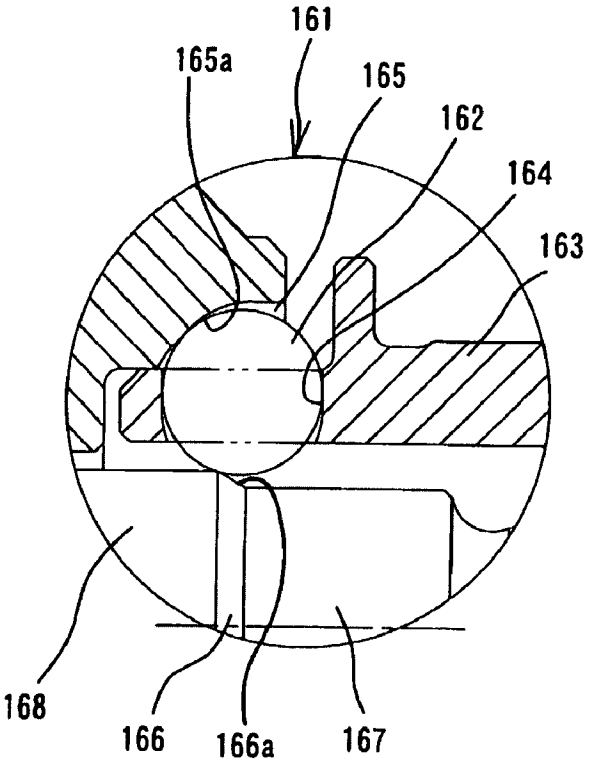
FIG. 13 shows the operation of the engagement speedup mechanism of the clutch mechanism at the time of clutch disengagement.
Figure 13:
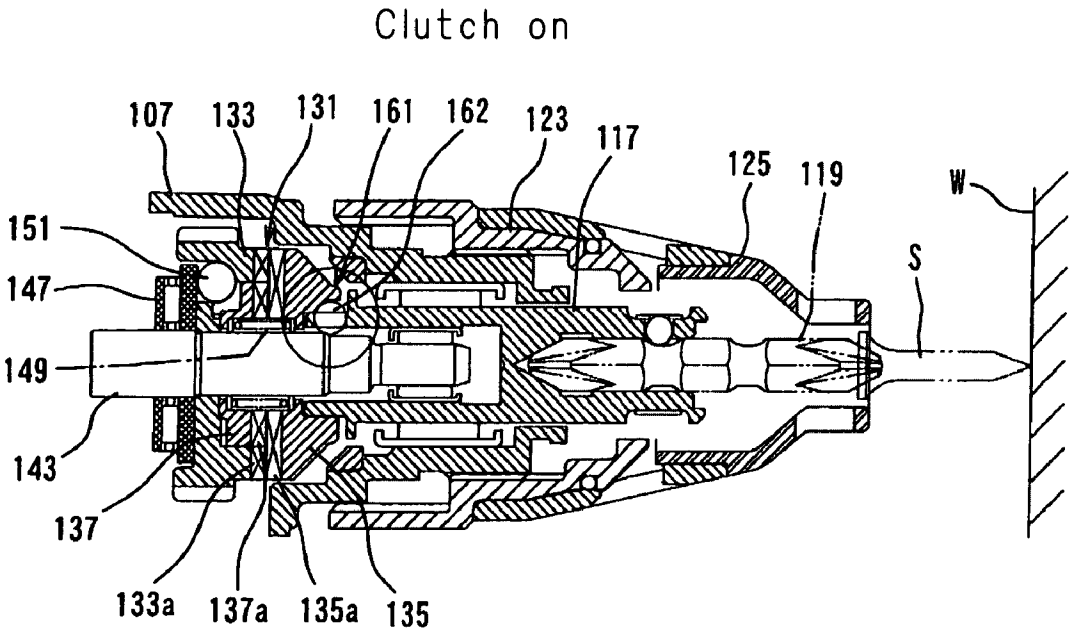

The engagement speedup mechanism 161 of the clutch mechanism 131 will now be explained. When the driver bit 119 is pressed against the workpiece W via the screw S in order to tighten the screw S, the spindle 117 retracts with respect to the body 103. At this time, the engagement speedup mechanism 161 serves to engage the driven-side clutch teeth 135*a* of the spindle-side clutch member 135 with the driving-side clutch teeth 133*a* and the auxiliary clutch teeth 137*a* at higher speed than the moving speed of the spindle 117. As shown in FIG. 2 and FIGS. 11 to 13, the engagement speedup mechanism 161 includes a plurality of (three in this embodiment) steel balls 162. The steel balls 162 are disposed between the spindle 117 and the spindle-side clutch member 135 and serves to connect the spindle 117 and the spindle-side clutch member 135. FIGS. 11 to 13 show the operation of the engagement speedup mechanism 161 and only the engagement speedup mechanism 161 is shown in enlarged view in a circle on the right side of each of the drawings.

The cylindrical portion 163 is formed in the rear end portion of the spindle 117. The spindle-side clutch member 135 is fitted on the rear end of the cylindrical portion 163 such that it can move in the axial direction with respect to the spindle 117. Forward movement of the spindle-side clutch member 135 is prevented by contact of the inclined front surface of the spindle-side clutch member 135 with the inclined surface of a stopper ring 127 that is mounted to the clutch housing 107. Three through holes 164 are formed in a portion of the cylindrical portion 163 of the spindle 117 which engages with the spindle-side clutch member 135 and extend radially through the cylindrical portion 163. The through holes 164 are arranged at equal intervals (of 120°) with respect to each other in the circumferential direction. Further, engagement recesses 165 are formed in the inner peripheral surface of the spindle-side clutch member 135 in positions which correspond to the positions of the through holes 164. The steel balls 162 engage with the engagement recesses 165. Each of the engagement recesses 165 has a generally quarter-spherical, inclined surface 165*a* that is inclined in such a manner as to widen forward (rightward as viewed in the drawings). Each of the steel balls 162 has such a large diameter that the steel ball 162 fitted in the associated through hole 164 protrudes to the outside and inside of the cylindrical portion 163. The portion of the steel ball 162 which protrudes to the outside engages with the associated engagement recess 165 of the spindle-side clutch member 135. The portion of the steel ball 162 which protrudes to the inside engages with the outer peripheral surface of the above-mentioned support shaft 143 within the cylindrical portion 163. In this manner, the spindle-side clutch member 135 and the spindle 117 are integrated in the circumferential direction via the steel balls 162, but can move in the axial direction with respect to each other.

A stepped portion 166 is radially formed in a portion of the outer peripheral surface of the support shaft 143 which is inserted into the cylindrical portion 163 of the spindle 117. The stepped portion 166 has an inclined surface 166*a* that is inclined or tapered forward (rightward as viewed in the drawings). Specifically, the support shaft 143 has a small-diameter portion 167 and a large-diameter portion 168, and the stepped portion 166 contiguously connect the small-diameter portion 167 and the large-diameter portion 168 by means of the inclined surface 166*a*. Under unloaded conditions in which the driver bit 119 is not pressed against the workpiece W, the steel balls 162 contact the small-diameter portion 167 of the support shaft 143. When the driver bit 119 is pressed against the workpiece W and the spindle 117 retracts, the steel balls 162 slide over the stepped portion 166. At this time, each of the steel balls 162 further protrudes to the outside of the cylindrical portion 163 and pushes the inclined surface 165*a* of the associated engagement recess 165 of the spindle-side clutch member 135. Thus, the spindle-side clutch member 135 is pushed rearward by axial component force acting upon the inclined surface 165*a* of the engagement recess 165. As a result, the spindle-side clutch member 135 retracts at higher speed than the retracting speed of the spindle 117.

Figure 15:
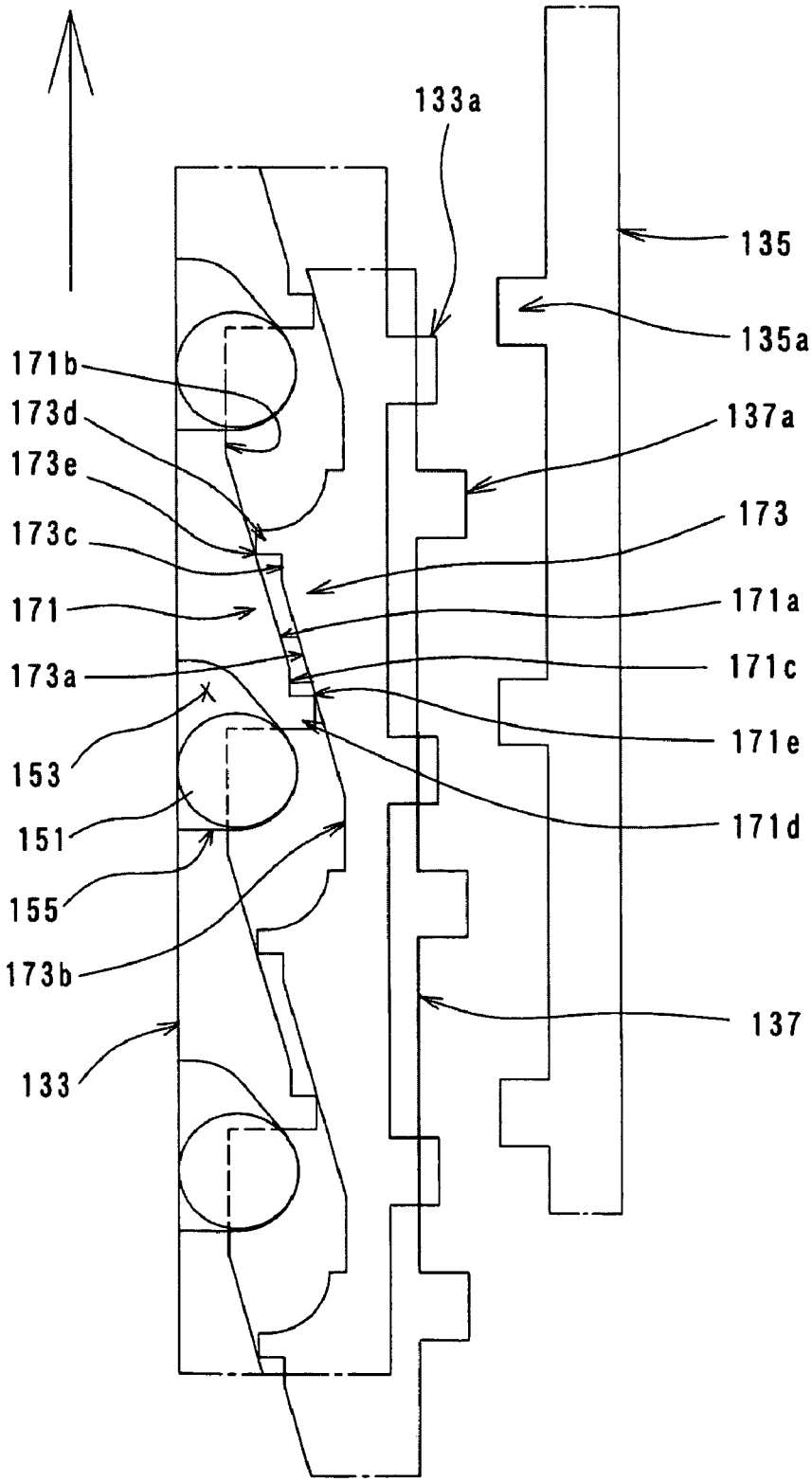
FIG. 15 is a developed view showing the connection between the driving-side clutch member and the clutch cam of the clutch mechanism in the reverse rotation, immediately after start of the motor.
Figure 16:
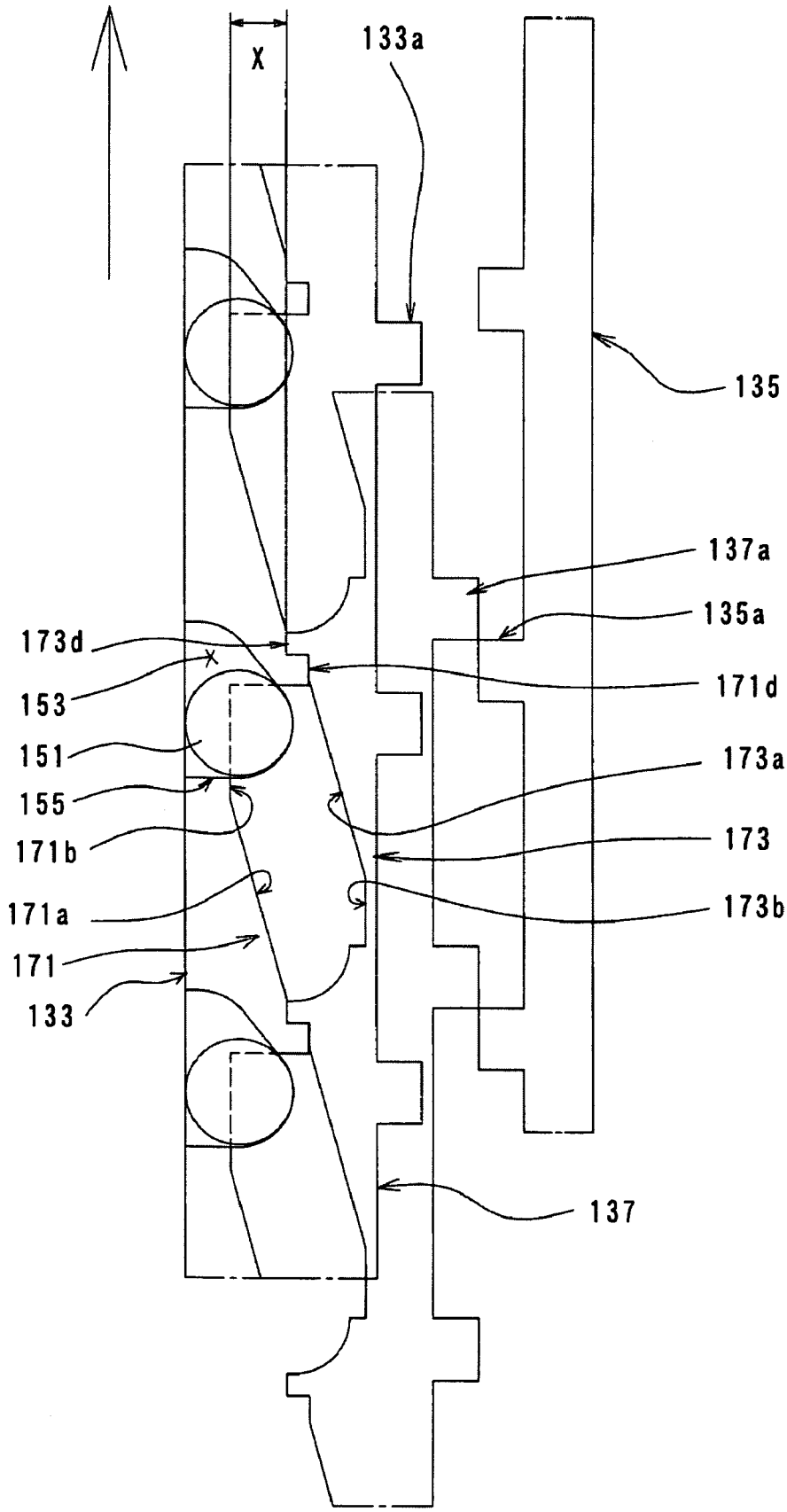
FIG. 16 is a developed view showing the connection between the driving-side clutch member and the clutch cam of the clutch mechanism in the reverse rotation, in the engaged state of the clutch mechanism.

Next, connection between the driving-side clutch member 133 and the clutch cam 137 in the reverse rotation when the motor 111 is driven in the reverse direction in order to loosen the screw S will now be explained with reference to FIGS. 14 to 16.

As shown in the drawings, during the reverse rotation of the driving-side clutch member 133, the driving-side clutch member 133 and the clutch cam 137 can move in the circumferential and axial directions with respect to each other via a driving-side end surface cam portion 171 of the driving-side clutch member 133 and a driven-side end surface cam portion 173 of the clutch cam 137. The driving-side and driven-side end surface cam portions 171 and 173 are features that correspond to the "inclined surface portions" in the present invention. The driving-side and driven-side end surface cam portions 171 and 173 face with each other in the axial direction and have inclined surfaces 171*a* and 173*a*, respectively, that are inclined at the same angle and extend in the circumferential direction. Further, the driving-side and driven-side end surface cam portions 171 and 173 have flat surfaces 171*b* and 173*b* for holding the disengagement position and flat surfaces 171*c* and 173*c* for holding the engagement position, respectively. The flat surfaces 171*b* and 173*b* extend from one longitudinal end of the inclined surfaces 171*a* and 173*a* in a direction perpendicular to the axial direction. The flat surfaces 171*c* and 173*c* extend from the other longitudinal end of the inclined surfaces 171*a* and 173*a* in a direction perpendicular to the axial direction. Further, projections 171*d* and 173*d* are formed on the side of the flat surfaces 171*c* and 173*c* for holding the disengagement position and extend from the end surface cam portions 171 and 173 in the axial direction.

Figure 14:
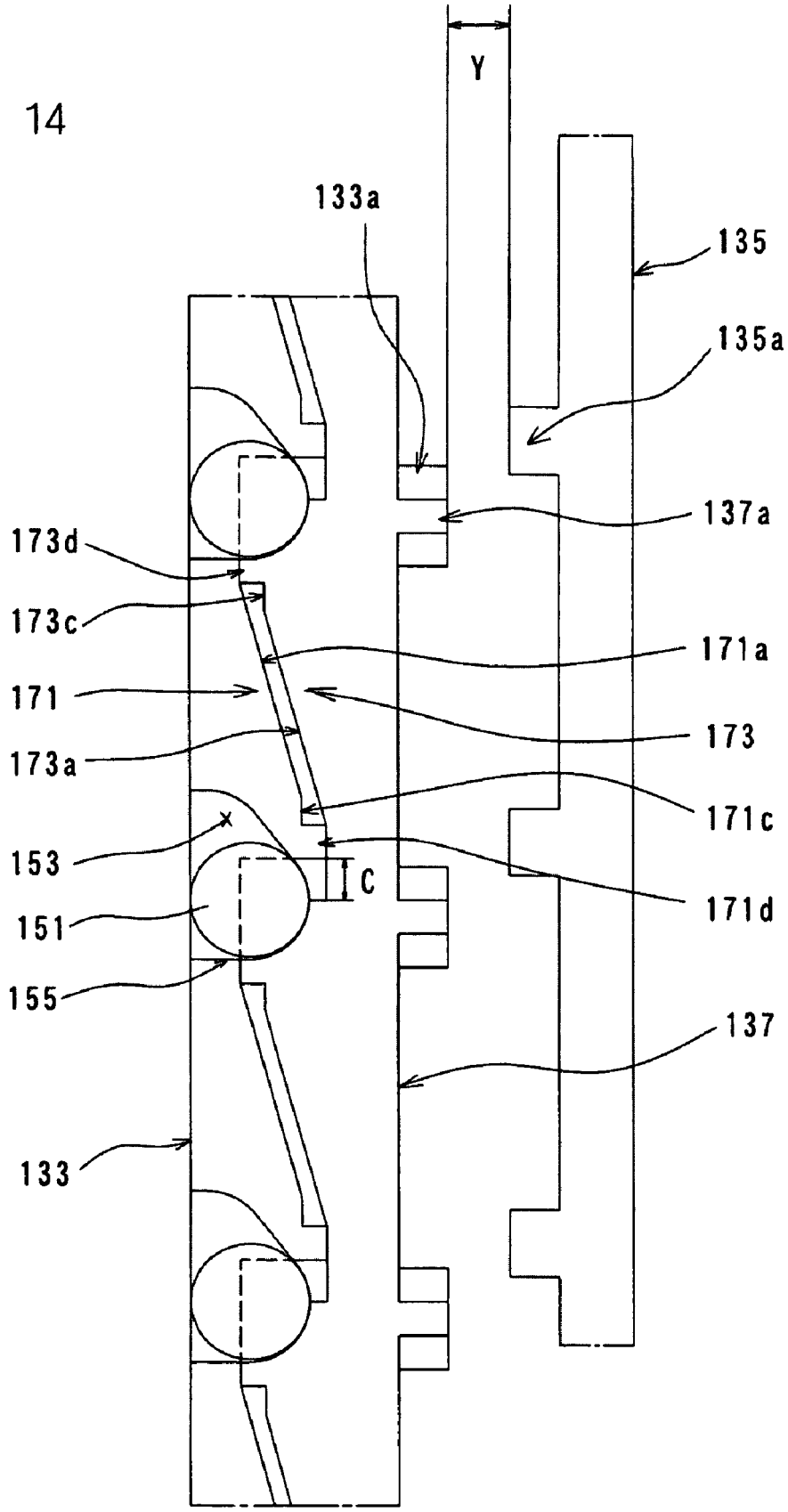
FIG. 14 is a developed view showing the connection between the driving-side clutch member and the clutch cam of the clutch mechanism in the reverse rotation during stop of the motor.

As shown in FIG. 14, when the motor 111 is stopped, the projection 171*d* of the driving-side end surface cam portion 171 contacts the flat surface 173*b* of the driven-side end surface cam portion 173, while the projection 173*d* of the driven-side end surface cam portion 173 contacts the flat surface 171*b* of the driving-side end surface cam portion 171. In this state, the clutch cam 137 is located apart from the spindle-side clutch member 135, so that the auxiliary clutch teeth 137*a* are disengaged from the driven-side clutch teeth 135*a*.

When the driving-side clutch member 133 is caused to rotate in the reverse direction by driving the motor 111 in the reverse direction, the clutch cam 137 is held stationary and the biasing force of the compression coil spring 149 is acting upon the clutch cam 137 as a force of holding it stationary. As a result, the driving-side clutch member 133 and the clutch cam 137 move in the circumferential direction with respect to each other. At this time, as shown in FIG. 15, the projection 171*d* of the driving-side end surface cam portion 171 slides on the inclined surface 173*a* of the driven-side end surface cam portion 173, while the projection 173*d* of the driven-side end surface cam portion 173 slides on the inclined surface 171*a* of the driving-side end surface cam portion 171. This sliding movement causes the driving-side clutch member 133 and the clutch cam 137 to move in the axial direction with respect to each other. At this time, however, the thrust bearing 147 prevents the axial movement of the driving-side clutch member 133. Therefore, only the clutch cam 137 is caused to move toward the driven-side clutch member 135. At this time, the amount of travel X of the clutch cam 137 is greater than the distance T between the auxiliary clutch teeth 137*a* of the clutch cam 137 and the driven-side clutch teeth 135*a* of the spindle-side clutch member 135 which are in the disengagement position. Thus, the axial movement of the clutch cam 137 causes the auxiliary clutch teeth 137*a* to engage with the driven-side clutch teeth 135*a*.

The driving-side clutch member 133 and the clutch cam 137 are prevented from moving in the circumferential direction with respect to each other by contact of a circumferential end surface of the projection 171*d* of the driving-side end surface cam portion 171 and a circumferential end surface of the projection 173*d* of the driven-side end surface cam portion 173. In this circumferential movement prevented position, the projection 171*d* of the driving-side end surface cam portion 171 contacts the flat engagement position holding surface 173*c* of the driven-side end surface cam portion 173, while the projection 173*d* of the driven-side end surface cam portion 173 contacts the flat engagement position holding surface 171*c* of the driving-side end surface cam portion 171. As a result, as shown in FIG. 16, the axial movement of the clutch cam 137 with respect to the driving-side clutch member 133 is limited, so that engagement of the auxiliary clutch teeth 137*a* and the driven-side clutch teeth 135*a* is maintained.

The projection 171*d* of the driving-side end surface cam portion 171 and the projection 173*d* of the driven-side end surface cam portion 173 are rectangular as shown in the drawings. Therefore, as shown in FIG. 15, the projections 171*d*, 173*d* slide on the inclined surfaces 171*a*, 173*a* in line contact via corners 171*e*, 173*e*. Thus, the projections 171*d*, 173*d* can slide smoothly with low friction. Further, the projections 171*d*, 173*d* make surface contact with the flat engagement position holding surfaces 171*c*, 173*c*. Therefore, the engagement between the auxiliary clutch teeth 137*a* and the driven-side clutch teeth 135*a* can be maintained even if, for example, the driving-side clutch member 133 and the clutch cam 137 slightly move in the circumferential direction with respect to each other.

As shown in FIG. 14, when the motor 111 is stopped, a predetermined clearance C is provided in the circumferential direction between the cam face 155 that is formed in the clutch cam 137 for pressing the steel ball 151 and the projection 171*d* of the driving-side end surface cam portion 171. The clearance C allows the driving-side clutch member 133 and the clutch cam 137 to move in the circumferential direction with respect to each other when the motor 11 is driven in the normal direction.

Operation of the electric screwdriver 101 having the above-mentioned construction will now be explained. First, it will be described for the operation of tightening the screw S by driving the motor 111 in the normal direction. FIGS. 3 to 6 show the operation of the clutch mechanism 131 during the tightening operation step by step. FIGS. 7 to 10 show the operation of components of the clutch mechanism 131 during the tightening operation in the order corresponding to that of FIGS. 3 to 6. FIGS. 11 to 13 show the operation of the engagement speedup mechanism 161 of the clutch mechanism 131 step by step.

Figure 3:
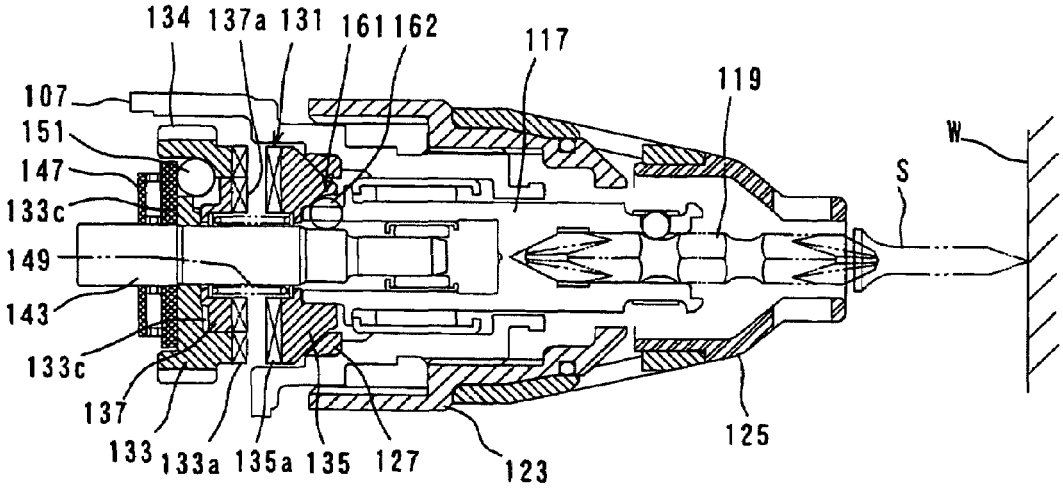
FIG. 3 is a sectional view showing the operation of a clutch mechanism during normal rotation under unloaded conditions.
Figure 4:
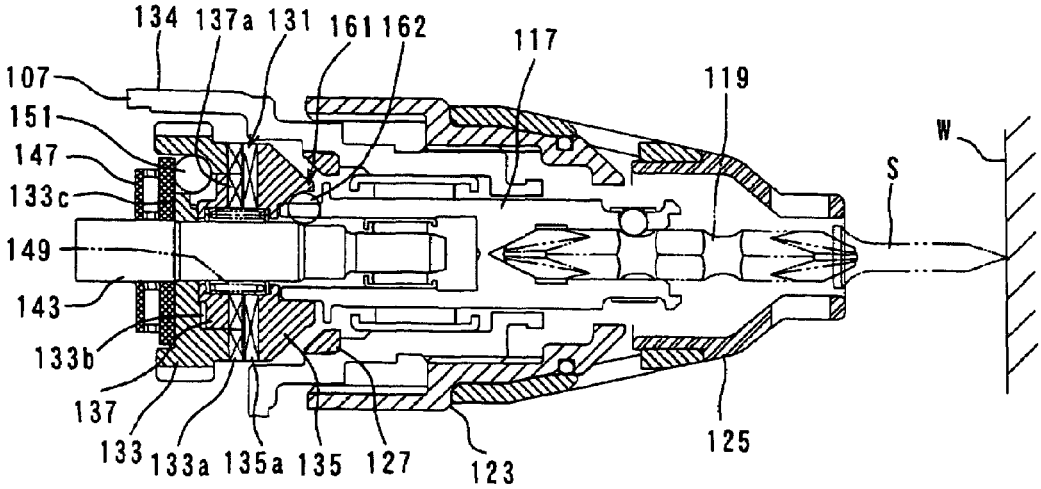
FIG. 4 is a sectional view showing the operation of the clutch mechanism during normal rotation at the time of clutch engagement.
Figure 5:
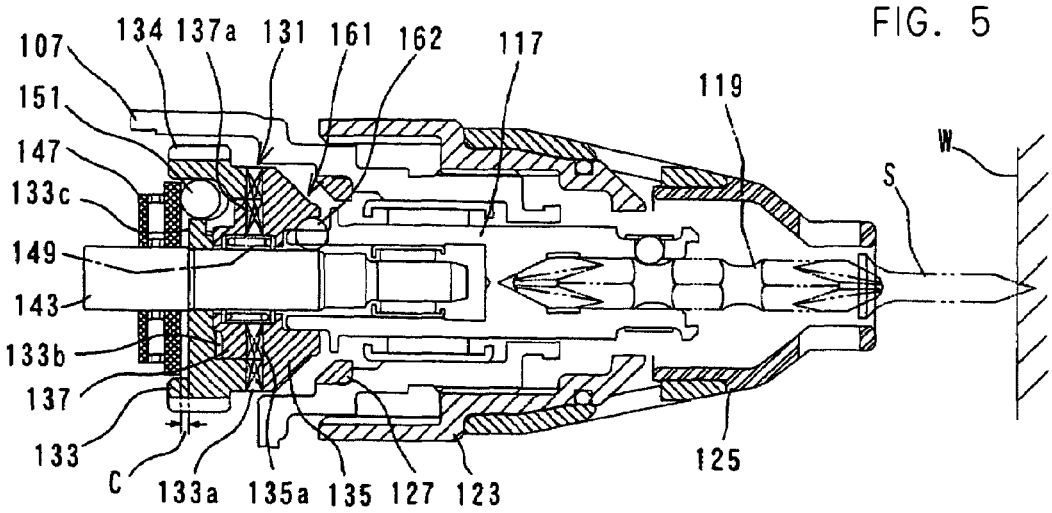
FIG. 5 is a sectional view showing the operation of the clutch mechanism during normal rotation during silent clutch operation.

FIG. 3 shows the state in which the screw S is set on the driver bit 119 and placed in position on the workpiece W under unloaded conditions in which the screwdriver 101 is not pressed in the screw-tightening direction. Under the unloaded conditions, the spindle-side clutch member 135 is separated from the driving-side clutch member 133 and the clutch cam 137 by the biasing force of the compression coil spring 149. Thus, the driven-side clutch teeth 135*a* are not engaged with the driving-side clutch teeth 133*a* and the auxiliary clutch teeth 137*a*, so that the clutch mechanism 131 is held disengaged.

In this disengaged state, the steel balls 162 of the engagement speedup mechanism 161 contact the small-diameter portion 167 of the support shaft 143 and protrude deepest into the inside of the cylindrical portion 163 of the spindle 117 (see FIG. 11). Further, the auxiliary clutch teeth 137*a* are located forward of the driving-side clutch teeth 133*a* in the rotational direction by the angle □. Each of the steel balls 151 is located in the deepest part of the groove bottom 153*a* of the associated lead groove 153 of the driving-side clutch member 133 (see FIG. 7). Thus, the steel balls 151 do not protrude from the rear surface 133*c* of the driving-side clutch member 133, and the rear surface 133*c* of the driving-side clutch member 133 contacts the thrust bearing 147. When, in the disengaged state of the clutch mechanism 131, a rotation selecting member of the motor 111 is switched to normal rotation and the trigger 121 is depressed to drive the motor 111, the driving-side clutch member 133 and the clutch cam 137 idle in the direction of normal rotation via the pinion gear 115 and the driving gear 134.

In this state, when the screw S on the driver bit 119 is pressed against the workpiece W by moving the screwdriver 101 forward (toward the workpiece W), the body 103 moves, but the driver bit 119 and the spindle 117 do not move. Therefore, the driver bit 119 and the spindle 117 retract (leftward as viewed in the drawing) with respect to the body 103 while compressing the compression coil spring 149. During this retraction of the spindle 117, the steel balls 162 held by the cylindrical portion 163 of the spindle 117 slide over the stepped portion 166 of the support shaft 143. At this time, each of the steel balls 162 is pushed to the outside of the cylindrical portion 163 and pushes the inclined surface 165*a* of the associated engagement recess 165 of the spindle-side clutch member 135. Thus, the spindle-side clutch member 135 is pushed rearward by axial component force acting upon the inclined surface 165*a* of the engagement recess 165. As a result, the spindle-side clutch member 135 retracts at higher speed than the retracting speed of the spindle 117 (see FIG. 12).

This retracting movement causes the driven-side clutch teeth 135*a* to move toward the driving-side clutch member 133 and the clutch cam 137. The driven-side clutch teeth 135*a* then engage with the auxiliary clutch teeth 137*a* before the driving-side clutch teeth 133*a* because the auxiliary clutch teeth 137*a* is located forward of the driving-side clutch teeth 133*a* in the rotational direction by the angle □. As a result, the clutch mechanism 131 is engaged and the rotating torque is transmitted to the spindle 117 via the spindle-side clutch member 135 (see FIGS. 4, 8 and 13). As a result, the spindle 117 and the driver bit 119 rotate in the normal direction and the operation of tightening the screw S is started. When the screw-tightening operation is started, the clutch cam 137 receives a load in the circumferential direction via the spindle-side clutch member 135, which causes the clutch cam 137 to move in a direction that delays its rotation with respect to the driving-side clutch member 133. As a result, the phase difference (of an angle $\alpha$) between the driving-side clutch teeth 133*a* and the auxiliary clutch teeth 137*a* becomes zero, and the driving-side clutch teeth 133*a* engage with the driven-side clutch teeth 135*a* (see FIG. 9(C)).

Figure 9:
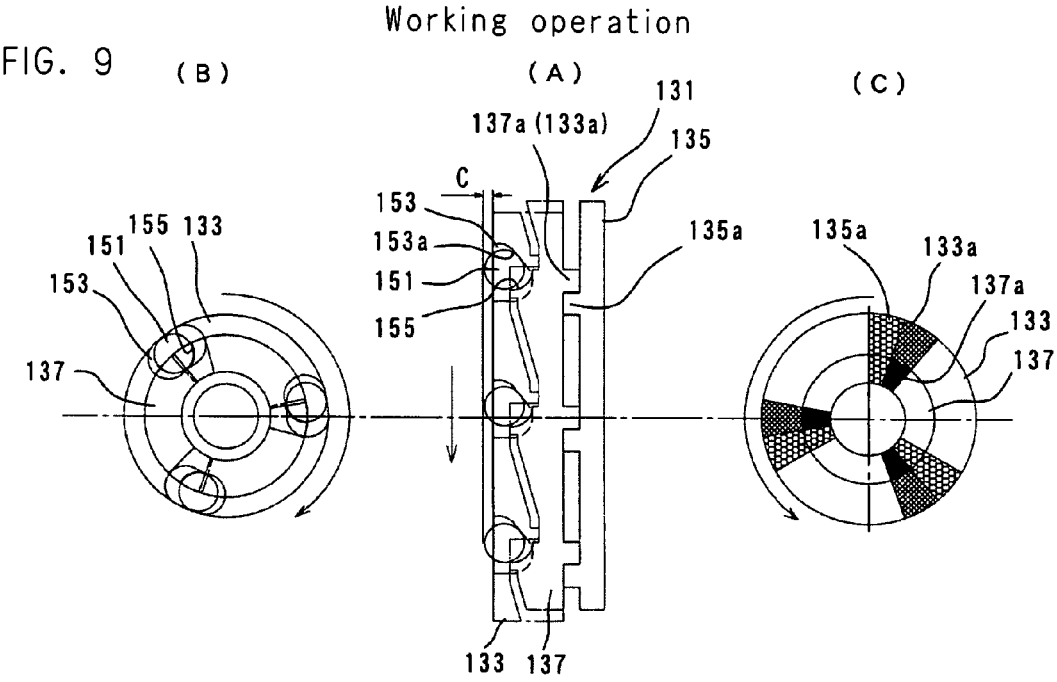
FIG. 9 shows the connection between the driving-side clutch member and the clutch cam in the normal rotation by steel balls of the clutch mechanism and the operation of the respective clutch teeth, during silent clutch operation.

When the clutch cam 137 is caused to move with respect to the driving-side clutch member 133 in the circumferential direction, each of the steel balls 151 fitted in the lead grooves 153 of the driving-side clutch member 133 is pushed by the associated cam face 155 of the clutch cam 137 and moved along the inclined surface of the groove bottom 153*a* toward a shallower part of the groove bottom 153*a* (upward as viewed in FIG. 9) within the associated lead groove 153 (see FIGS. 9(A) and 9(C)). Thus, part of the steel ball 151 protrudes from the rear surface 133*c* of the driving-side clutch member 133 toward the thrust bearing 147. As a result, the driving-side clutch member 133 and the clutch cam 137 move forward (toward the spindle-side clutch member 135) while compressing the compression coil spring 149. By this forward movement, the driving-side clutch teeth 133*a* and the auxiliary clutch teeth 137*a* engage deeply (completely) with the driven-side clutch teeth 135*a* Further, a clearance C is created between the rear surface 133*c* of the driving-side clutch member 133 and the front surface of the rust bearing 147 (see FIGS. 5 and 9(A)). Upon completion of the screw-tightening operation, this clearance C serves to allow the driving-side clutch member 133 and the clutch cam 137 to idle quietly while holding the clutch mechanism 131 in the disengaged state. The movement of the driving-side clutch member 133 and the clutch cam 137 toward the spindle-side clutch member 135 to create the clearance C is a silent clutch operation.

Figure 6:
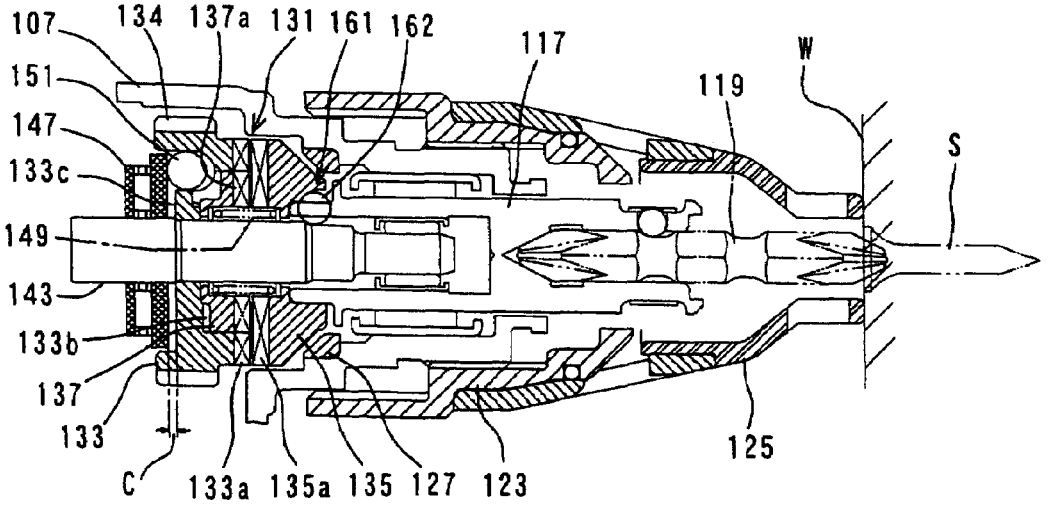
FIG. 6 is a sectional view showing the operation of the clutch mechanism during normal rotation at the time of clutch disengagement.
Figure 7:
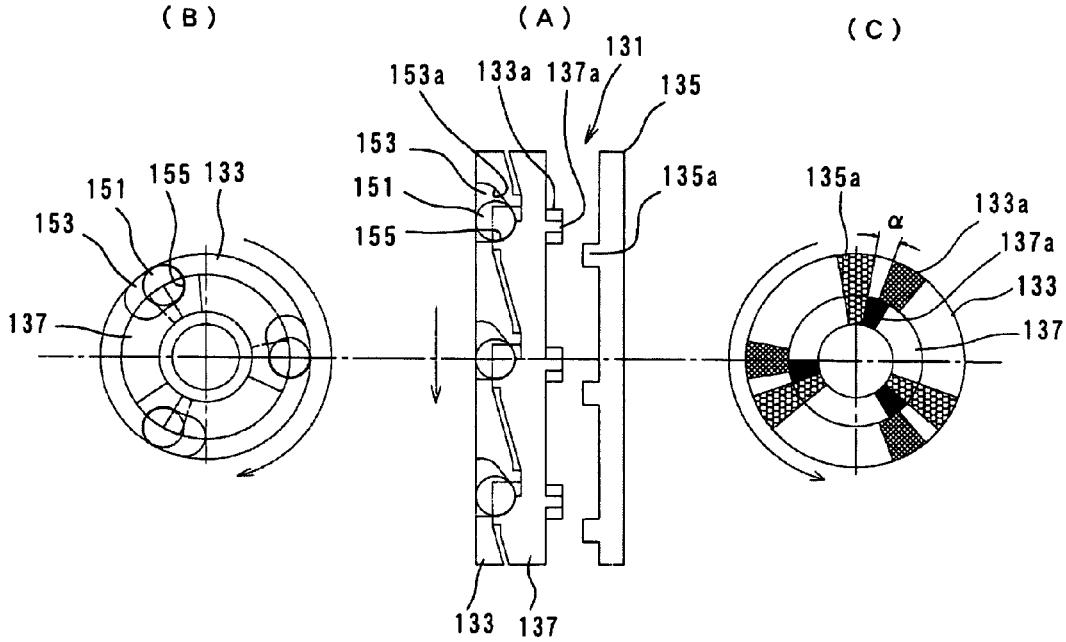
FIG. 7 shows the connection between a driving-side clutch member and a clutch cam in the normal rotation by steel balls of the clutch mechanism and the operation of the respective clutch teeth under unloaded conditions.
Figure 8:
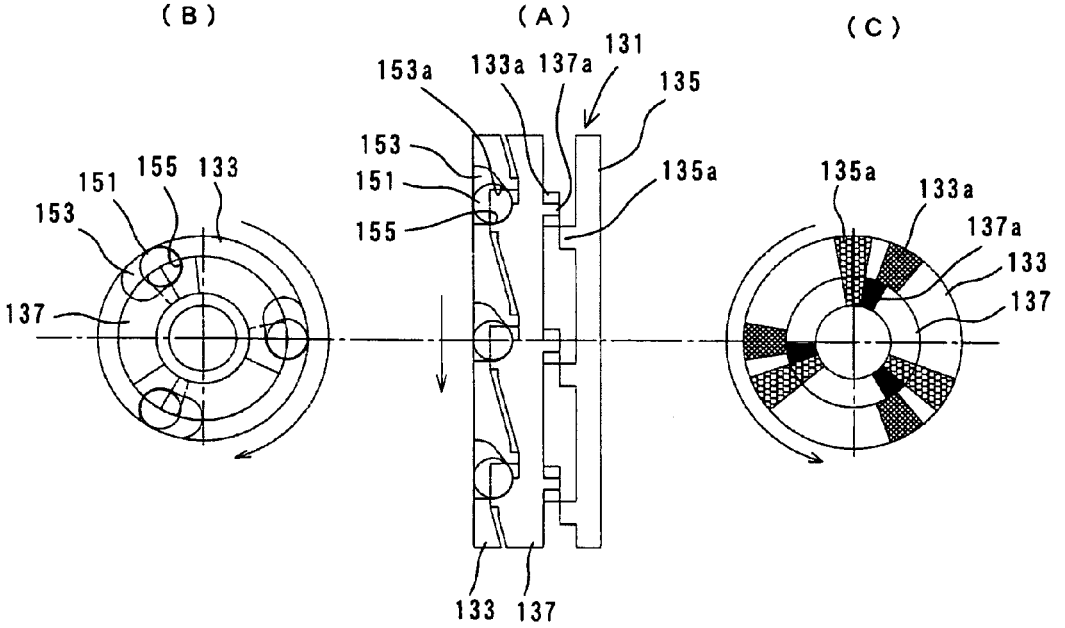
FIG. 8 shows the connection between the driving-side clutch member and the clutch cam in the normal rotation by steel balls of the clutch mechanism and the operation of the respective clutch teeth at the time of clutch engagement.
Figure 10:
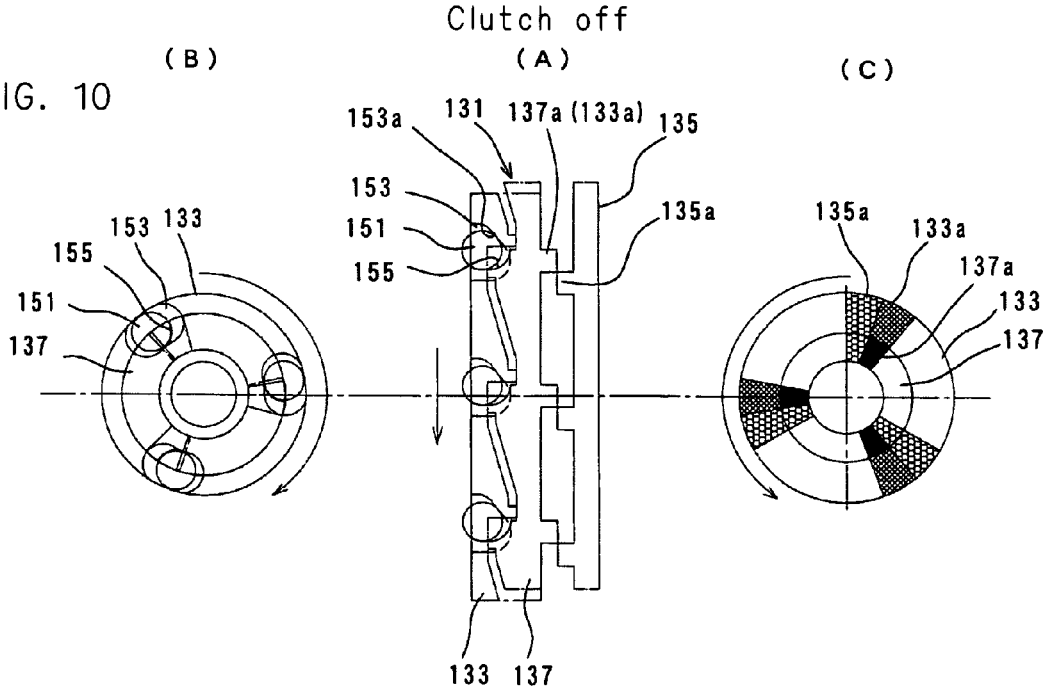
FIG. 10 shows the connection between the driving-side clutch member and the clutch cam in the normal rotation by steel balls of the clutch mechanism and the operation of the respective clutch teeth at the time of clutch disengagement.

Thereafter, the screw-tightening operation proceeds in the completely engaged state of the clutch mechanism 131 and the tip end of the stopper sleeve 125 contacts the workpiece W. In this state, the screw S is further tightened by the rotating torque of the spindle 117 and the driver bit 119 because the clutch mechanism 131 is engaged. As a result, the spindle-side clutch member 135 and the spindle 117 which have been biased forward by the compression coil spring 149 move forward. Thus, the driven-side clutch teeth 135*a* gradually move away from the driving-side clutch teeth 133*a* and the auxiliary clutch teeth 137*a* into incomplete engagement and finally into complete disengagement. Then, the operation of tightening the screw S is completed. Immediately before this clutch disengagement, each of the steel balls 162 of the engagement speedup mechanism 161 moves from the large-diameter portion 168 of the support shaft 143 to the small-diameter portion 167 via the inclined surface 166*a* of the stepped portion 166. As a result, the pressing force of the steel ball 162 is no longer applied on the inclined surface 165*a* of the associated engagement recess 165, so that the spindle-side clutch member 135 moves forward by the biasing force of the compression coil spring 149. The spindle-side clutch member 135 moves forward at higher speed than the spindle 117. Thus, faster clutch disengagement is achieved. This state is shown in FIGS. 6 and 10.

When the clutch mechanism 131 is thus disengaged, a circumferential load applied by screw-tightening is no longer applied on the clutch cam 137. At this time, the biasing force of the compression coil spring 149 is applied to the clutch cam 137 from the steel balls 151, which are in contact with the thrust bearing 147, via the cam faces 155 of the clutch cam 137 in a direction opposite to the above-mentioned circumferential load. Therefore, in the absence of the circumferential load on the clutch cam 137, the clutch cam 137 moves in the circumferential direction with respect to the driving-side clutch member 133, which causes each of the steel balls 151 to move toward a deeper part of the groove bottom 153*a* of the associated lead groove 153. As a result, the driving-side clutch member 133 and the clutch cam 137 move into contact with the thrust bearing 147. The amount of this travel corresponds to the amount of the clearance C created by the above-mentioned silent clutch operation. Thus, a proper clearance for avoiding interference is created between the driving-side clutch teeth 133*a* and auxiliary clutch teeth 137*a* and the driven-side clutch teeth 135*a*. By provision of such clearance, after clutch disengagement, the driven-side clutch teeth 135*a* can be held disengaged from the driving-side clutch teeth 133*a* and auxiliary clutch teeth 137*a*. As a result, the clutch mechanism 131 can idle quietly without interference of the driving-side clutch teeth 133*a* and auxiliary clutch teeth 137*a* with the driven-side clutch teeth 135*a* and can suitably perform the function as a silent clutch.

As mentioned above, with the clutch mechanism 131 according to this embodiment, during the operation of tightening the screw S by driving the motor 111 in the normal direction, the driving-side clutch teeth 133*a* of the driving-side clutch member 133 which is rotated in the normal direction by the motor 111 engage with the driven-side clutch teeth 135*a* of the spindle-side clutch member 135. However, before this engagement between the clutch teeth 133*a* and 135*a*, the auxiliary clutch teeth 137*a* of the clutch cam 137 which rotates together with the driving-side clutch member 133 engage with the driven-side clutch teeth 135*a*. Thereafter, the clutch cam 137 moves in the circumferential direction with respect to the driving-side clutch member 133 and the driving-side clutch teeth 133*a* engage with the driven-side clutch teeth 135*a*. Specifically, the auxiliary clutch teeth 137*a* of the clutch cam 137 receives an impact load of the engagement of the clutch mechanism 131, and thereafter, the driving-side clutch teeth 133*a* of the driving-side clutch member 133 engage with the driven-side clutch teeth 135*a* of the spindle-side clutch member 135. Thus, the clutch cam 137 serves as a cushion for engagement between the driving-side clutch member 133 and the spindle-side clutch member 135. As a result, the impact of engagement between the driving-side clutch member 133 and the spindle-side clutch member 135 can be alleviated.

The clutch cam 137 which has engaged with the driven-side clutch teeth 135*a* of the spindle-side clutch member 135 receives a rotating torque from the spindle-side clutch member 135 and moves in a direction that delays (retracts) with respect to the rotation in the normal direction while compressing the compression coil spring 149. Therefore, the impact of engagement between the auxiliary clutch teeth 137*a* and the driven-side clutch teeth 135*a* can also be alleviated. Further, the driving-side clutch teeth 133*a* and the auxiliary clutch teeth 137*a* engage with the driven-side clutch teeth 135*a* in surface contact. The mating surfaces of the clutch teeth 133*a*, 135*a*, 137*a* are flat and extend in directions crossing the circumferential direction. Therefore, the load per unit contact area on the mating surfaces can be reduced, and friction can be reduced.

Further, the clutch cam 137 moves with respect to the driving-side clutch member 133 within a range defined by the circumferential length of the lead groove 153. In this embodiment, the clutch cam 137 is allowed to further move in a direction that delays its rotation when the driving-side clutch teeth 133*a* is in engagement with the driven-side clutch teeth 135*a*. Therefore, the driving-side clutch member 133 can receive the load of disengagement of the clutch mechanism 131, while the clutch cam 137 can receive the load of engagement.

As mentioned above, with the clutch mechanism 131 according to this embodiment, during the operation of tightening the screw S by driving the motor 111 in the normal direction, the impact of the clutch engagement can be alleviated. As a result, durability of the driving-side clutch member 133, the clutch cam 137 and the spindle-side clutch member 135 can be increased, so that the life can be prolonged.

Further, in this embodiment, the clutch cam 137 is disposed within the circular recess 133*b* of the driving-side clutch member 133, and the front surface of the clutch cam 137 is flush with the front surface of the driving-side clutch member 133. With such construction, the axial length of the clutch mechanism 131 having the clutch cam 137 between the driving-side clutch member 133 and the spindle-side clutch member 135 can be shortened to the same length as a clutch mechanism without the clutch cam 137. Thus, the length of the screwdriver 101 can be shortened.

Further, in this embodiment, the steel balls 151 are used for silent clutch operation as axial displacement means for displacing the driving-side clutch member 133 in the axial direction. Each of the steel balls 151 rolls along the inclined surface of the groove bottom 153*a* of the associated lead groove 153 of the driving-side clutch member 133. This rolling movement is utilized to move the driving-side clutch member 133 in the axial direction. Therefore, smooth movement of the driving-side clutch member 133 can be achieved with lower frictional resistance.

Further, the clutch mechanism 131 according to this embodiment has the engagement speedup mechanism 161 between the spindle 117 and the spindle-side clutch member 135, which allows the spindle-side clutch member 135 to move at higher speed than the spindle 117. Thus, the speed of engagement of the driven-side clutch teeth 135*a* with the auxiliary clutch teeth 137*a* increases. Further, the number of times that the driven-side clutch teeth 135*a* and the auxiliary clutch teeth 137*a* ride past each other (the number of times that the axial end surfaces of the clutch teeth 135*a*, 137*a* interfere with each other) in order to achieve the engagement decreases, so that the clutch engagement can be more easily made. As a result, the friction between the clutch teeth 135*a* and 137*a* is reduced, so that the life of the clutch mechanism 131 can be prolonged.

Further, in this embodiment, the inclined surface 165*a* of the engagement recess 165 of the spindle-side clutch member 135 engages with the associated steel ball 162. Therefore, the rotating torque of the spindle-side clutch member 135 is transmitted to the spindle 117 via the steel balls 162. Specifically, the steel balls 162 serve not only as an engagement speedup member for moving the spindle-side clutch member 135 at higher speed than the spindle 117, but as a member for transmitting the rotating torque. Therefore, the fit between the spindle-side clutch member 135 and the spindle 117 allows transmission of the rotating torque and can be simplified in structure without need for spline engagement.

Next, operation of loosening the screw S driven into the workpiece W will now be explained with reference to FIGS. 14 to 16. FIG. 14 shows the state in which the motor is stopped. At this time, the projection 171*d* of the driving-side end surface cam portion 171 and the projection 173*d* of the driven-side end surface cam portion 173 contact the associated flat surfaces 173*b* and 171*b* for keeping the disengagement position, respectively. In this state, when the rotation selecting member of the motor 111 is changed to the reverse direction and the motor 111 is driven in the reverse direction by depressing the trigger 121, the driving-side clutch member 133 is caused to rotate in the reverse direction via the pinion gear 115 and the driving gear 134. At this time, as mentioned above, the clutch cam 137 is held stationary and the biasing force of the compression coil spring 149 is acting upon the clutch cam 137 as a force of holding it stationary.

As a result, the driving-side clutch member 133 and the clutch cam 137 move in the circumferential direction with respect to each other. By this movement, the projection 171*d* of the driving-side end surface cam portion 171 slides on the inclined surface 173*a* of the driven-side end surface cam portion 173, while the projection 173*d* of the driven-side end surface cam portion 173 slides on the inclined surface 171*a* of the driving-side end surface cam portion 171. As shown in FIG. 15, this sliding movement causes the clutch cam 137 to move away from the driving-side clutch member 133 against the biasing force of the compression coil spring 149, or toward the driven-side clutch member 135. As a result, the auxiliary clutch teeth 137*a* of the clutch cam 137 engage with the driven-side clutch teeth 135*a* of the spindle-side clutch member 135.

At this time, the movement of the driving-side clutch member 133 and the clutch cam 137 in the circumferential direction with respect to each other is prevented by contact between the projections 171*d* and 173*d*. Thus, the driving-side clutch member 133 and the clutch cam 137 are locked to each other in the reverse direction and rotate together. This rotating torque is transmitted to the spindle-side clutch member 135 via engagement between the auxiliary clutch teeth 137*a* and the driven-side clutch teeth 135*a*, which causes the driver bit 119 to rotate in the reverse direction via the spindle 117.

Thus, according to this embodiment, the clutch mechanism 131 can be directly engaged and the driver bit 119 is caused to rotate in the reverse direction solely by driving the motor 111 in the reverse direction. In order to perform the operation of loosening the screw S, first, the tip end of the driver bit 119 is placed on the head of the screw S to be loosened, and then the motor 111 is driven in the reverse direction. Then, the torque of the motor 111 in the reverse direction can be transmitted from the driving-side clutch member 133 to the driven-side clutch member 135. At this time, it is not necessary for the user to apply a pressing force to the body 103. In this manner, the operation of loosening the screw S can be easily performed. Specifically, according to this embodiment, during the reverse rotation of the motor 111, the driver bit 119 can be rotated in the reverse direction without application of the pressing force of the user to the body 103, or without pressing the tip end of the stopper sleeve 125 against the workpiece W. Therefore, the operation of loosening the screw S can be performed with the stopper sleeve 125 left attached to the body 103. Thus, the workability can be improved.

In this case, when a pressing force is applied to the body 103 with the driver bit 119 set on the head of the screw S, the spindle-side clutch member 135 is caused to retract via the driver bit 119 and the spindle 117, and the driven-side clutch teeth 135*a* deeply engage with the driving-side clutch teeth 133*a* and the auxiliary clutch teeth 137*a*. Therefore, the operation of loosening the screw S can be performed in the state of stable engagement.

Further, in this embodiment, the axial end surface of the projection 171*d* of the driving-side end surface cam portion 171 and the axial end surface of the projection 173*d* of the driven-side end surface cam portion 173 make surface contact with the flat engagement position holding surfaces 173*c*, 171*c* in the position in which the driving-side clutch member 133 and the clutch cam 137 are prevented from moving in the circumferential direction with respect to each other by contact between the projections 171*d*, 173*d*. In this manner, engagement between the auxiliary clutch teeth 137*a* and the driven-side clutch teeth 135*a* is maintained. With such construction, the engagement between the auxiliary clutch teeth 137*a* and the driven-side clutch teeth 135*a* can be reliably maintained even if, for example, the driving-side clutch member 133 and the clutch cam 137 slightly displace in the circumferential direction with respect to each other. Therefore, the operation of loosening the screw S can be performed in a stable state.

Although, in this embodiment, the driving-side end surface cam portion 171 and the driven-side end surface cam portion 173 have the inclined surfaces 171*a* and 173*a*, respectively, either of the inclined surfaces may be omitted.

Second Embodiment

Figure 17:
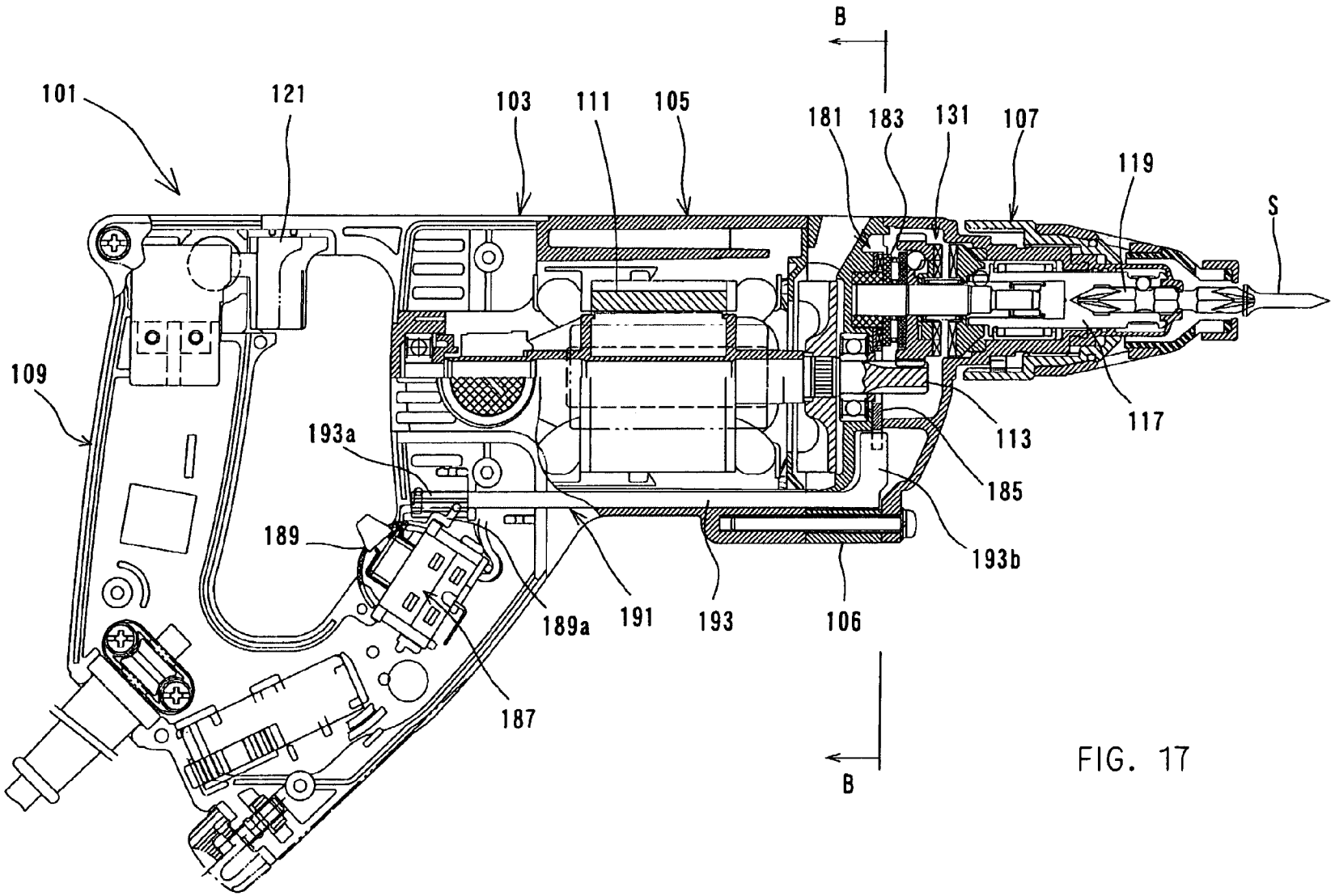
FIG. 17 is a side view, partly in section, schematically showing an entire screw driver having the clutch mechanism equipped with an engagement position changing mechanism according to a second embodiment of the invention.
Figure 18:
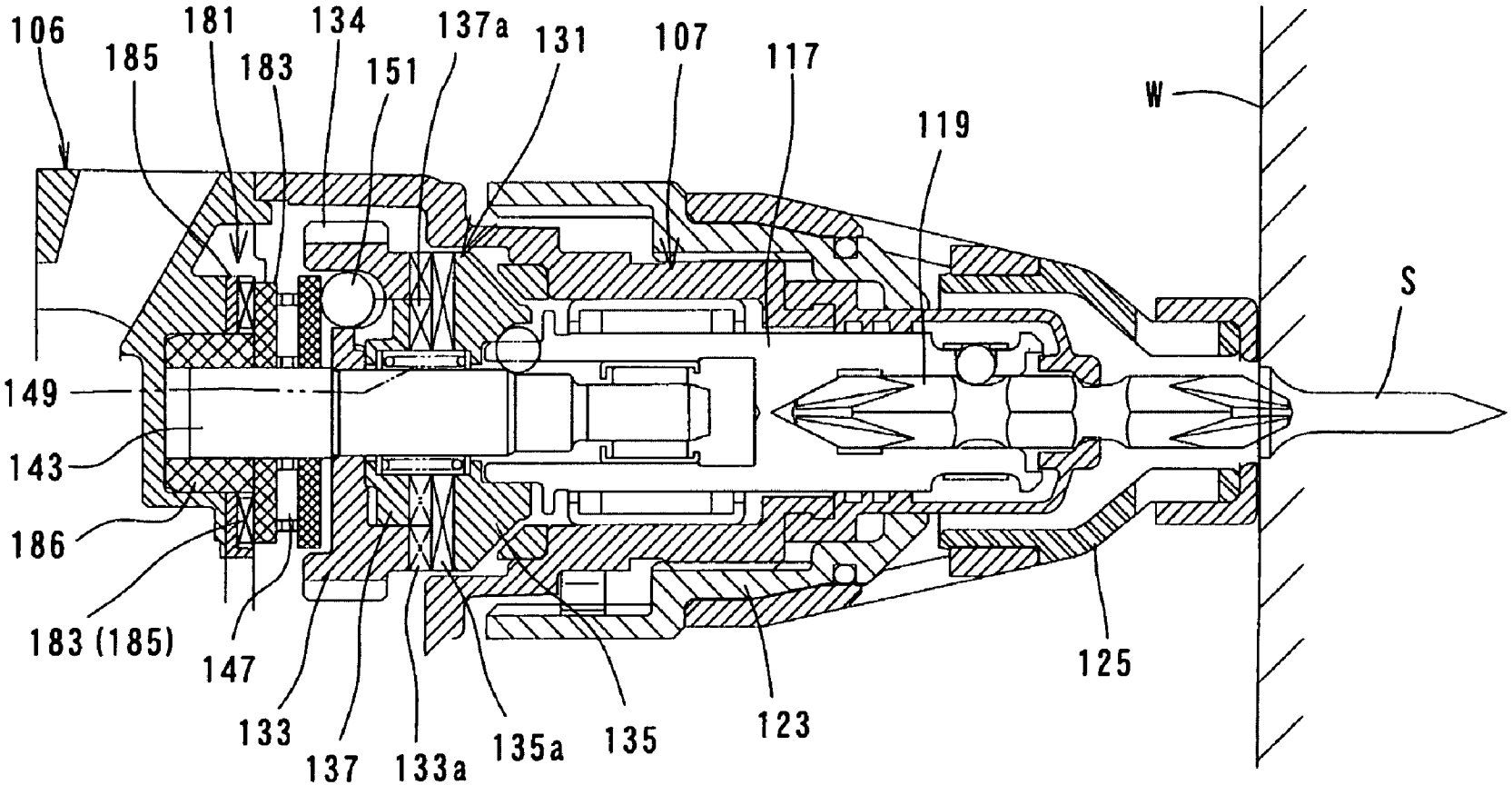
FIG. 18 shows the clutch mechanism immediately after completion of screw-tightening operation.
Figure 19:
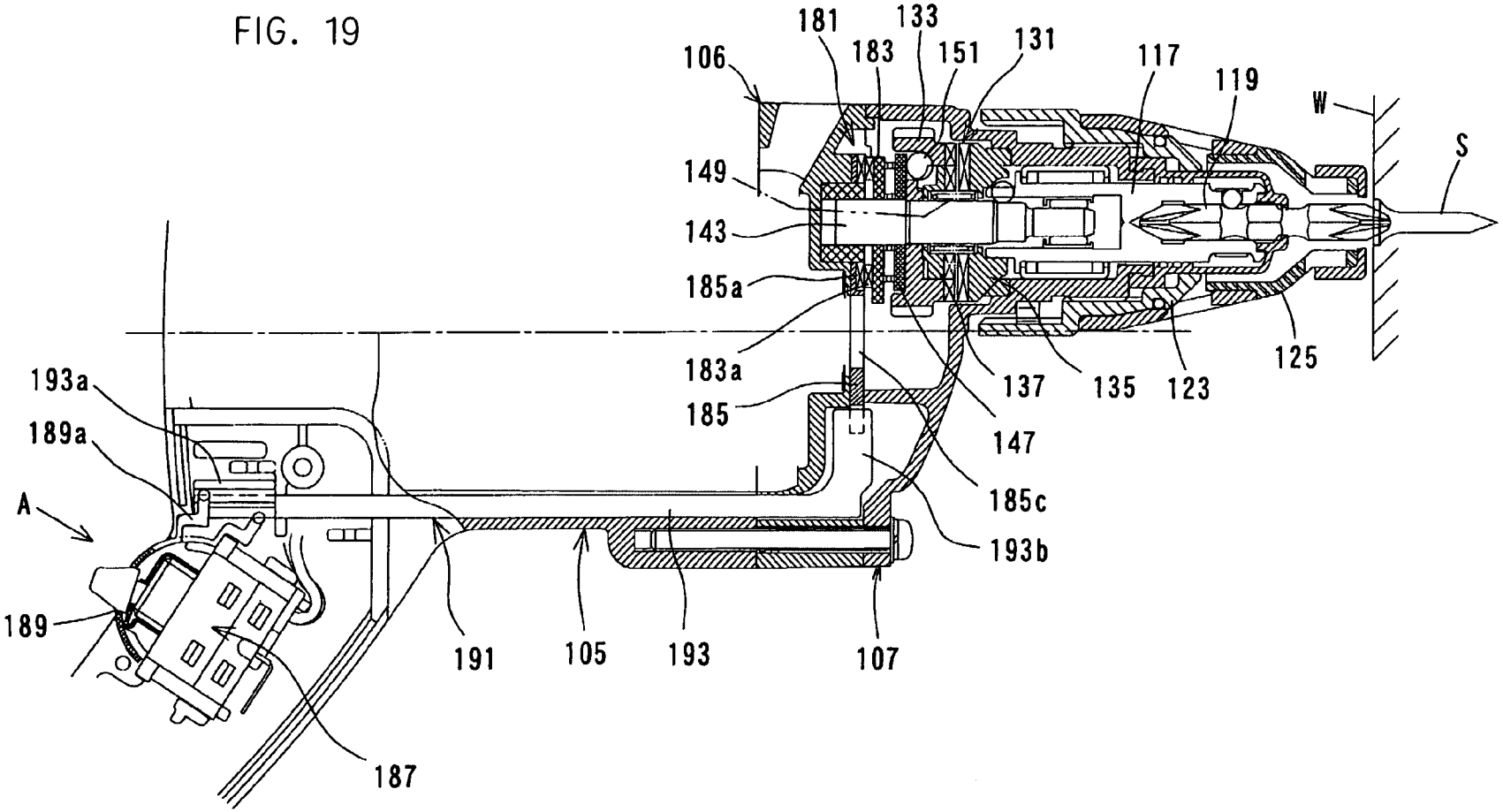
FIG. 19 shows the clutch mechanism at the time of change to the screw-loosening mode.
Figure 20:
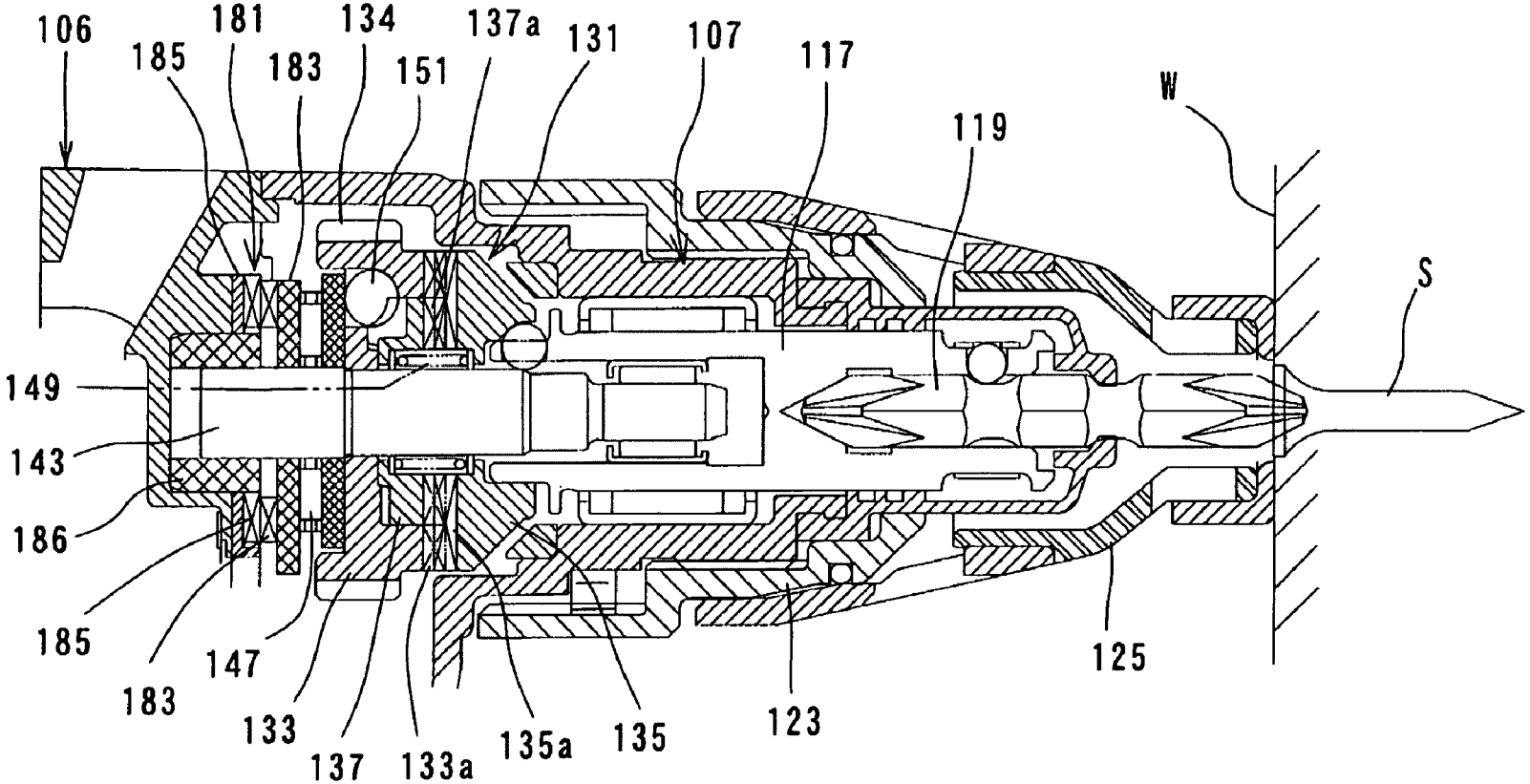
FIG. 20 shows the clutch mechanism during screw-loosening operation.
Figure 21:
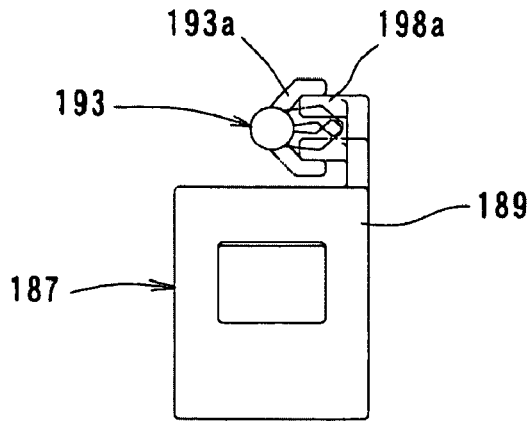
FIG. 21 is a view taken from the direction shown by arrow A in FIG. 19.
Figure 22:
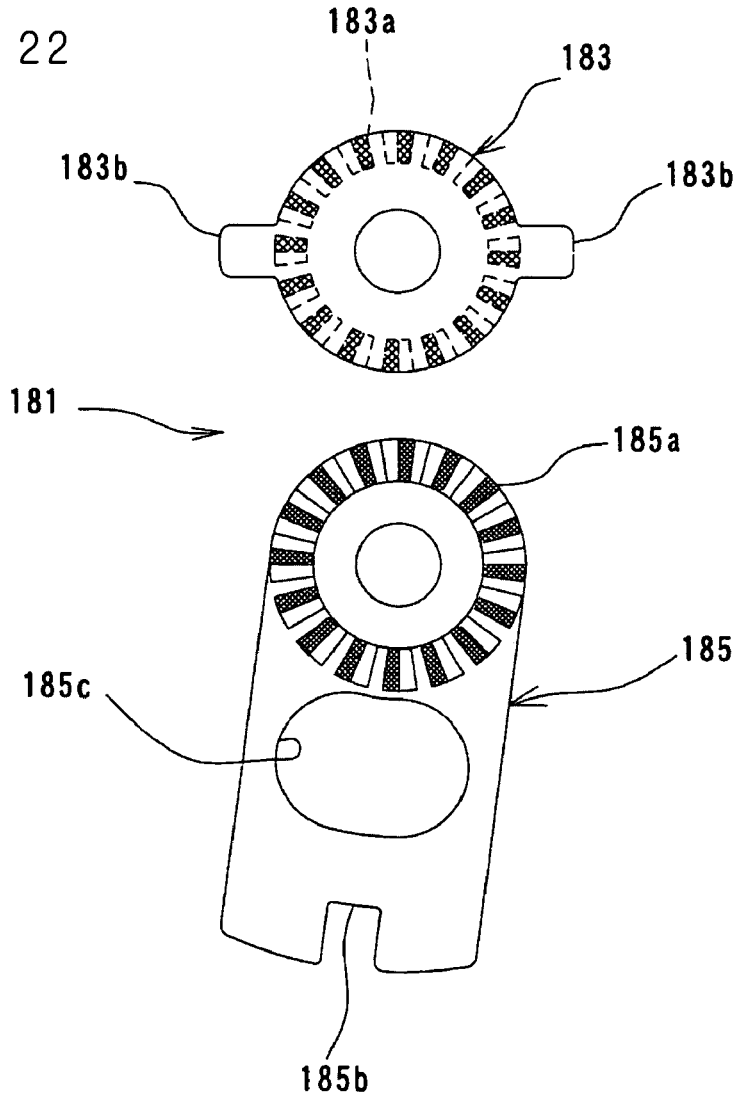
FIG. 22 shows components of the engagement position changing mechanism.

A second embodiment of the present invention will now be described with reference to FIGS. 17 to 24. In this embodiment, an engagement position changing mechanism 181 is provided which is manually operated by the user and serves to switch between tightening mode and loosening mode of operation of the driver bit 119 by changing the engagement position of the clutch mechanism 131 during normal and reverse rotation of the motor 111. The other construction is similar to that of the first embodiment. Therefore, components identical or substantially identical to those in the first embodiment are given like numerals as in the first embodiment and will not be described. FIG. 17 shows the entire screwdriver 101 having the clutch mechanism 131 equipped with the engagement position changing mechanism 181. FIGS. 18 to 20 show the operation of the clutch mechanism 131. FIG. 18 shows the clutch mechanism 131 immediately after operation of tightening the screw S has been completed, FIG. 19 shows the clutch mechanism 131 at the time of change to the mode of loosening the screw S, and FIG. 20 shows the clutch mechanism 131 during operation of loosening the screw S. FIG. 21 is a view taken from the direction shown by arrow "A" in FIG. 19. FIG. 22 shows components of the engagement position changing mechanism 181.

The engagement position changing mechanism 181 is provided as a means for moving the driving-side clutch teeth 133*a* and the auxiliary clutch teeth 137*a* toward and away from the driven-side clutch teeth 135*a* of the spindle-side clutch member 135 by moving (advancing and retracting) the driving-side clutch member 133 and the clutch cam 137 in the axial direction. The position of the mode of loosening the screw S is the forward position to which the driving-side clutch member 133 and the clutch cam 137 are moved toward the spindle-side clutch member 135. The position of the mode of tightening the screw S is the rearward position to which the driving-side clutch member 133 and the clutch cam 137 are moved away from the spindle-side clutch member 135.

Figure 23:
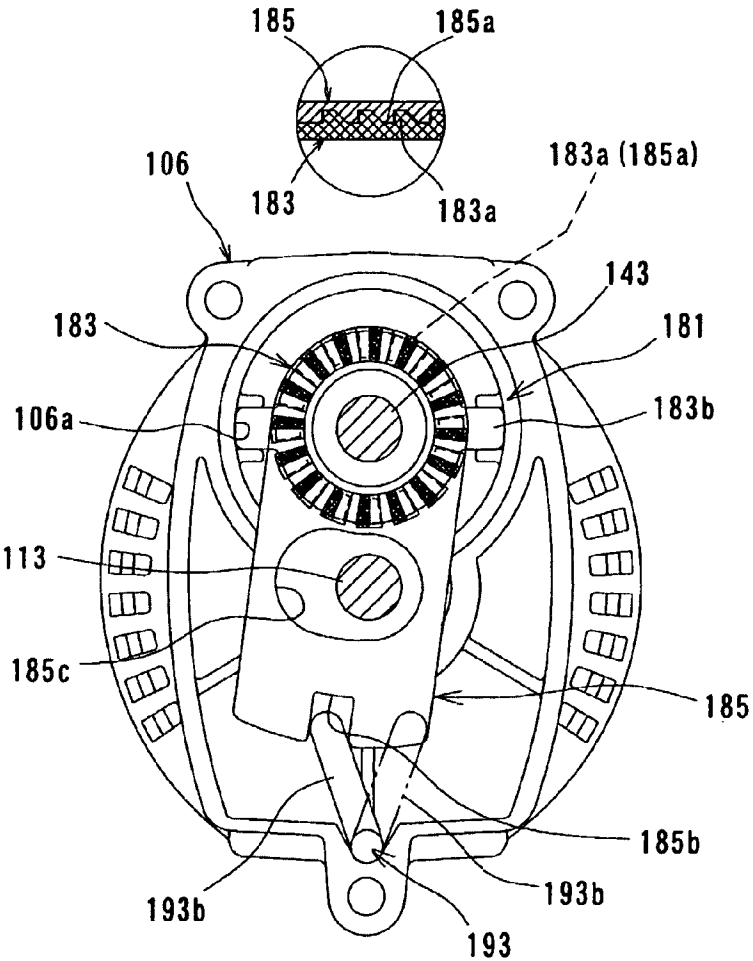
FIG. 23 is a sectional view taken along line B-B in FIG. 17, in the state in which the engagement position changing mechanism is placed in the tightening operation mode.
Figure 24:
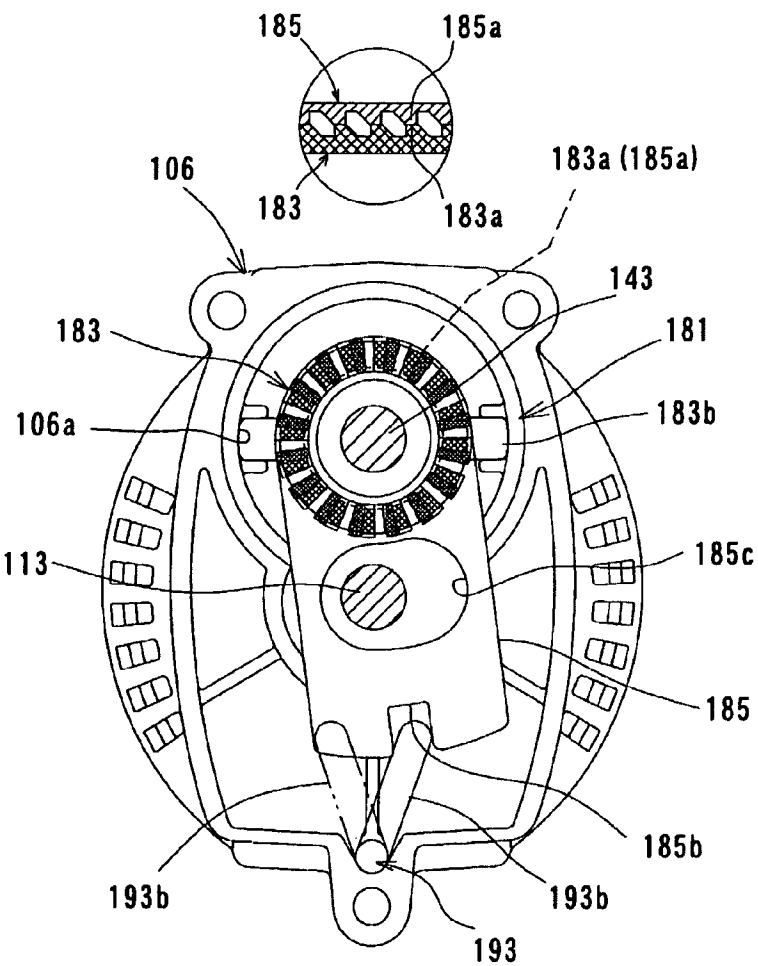
FIG. 24 is a sectional view taken along line B-B in FIG. 17, in the state in which the engagement position changing mechanism is placed in the loosening operation mode.

As shown in FIG. 22, the engagement position changing mechanism 181 includes a disc-like washer 183 and a plate-like engagement position selection lever 185. As shown in FIGS. 17 to 20, the washer 183 and the engagement position selection lever 185 are disposed between the fan housing 106 and the thrust bearing 147. The fan housing 106 is disposed between the motor housing 105 and the clutch housing 107. The washer 183 serves also as one roller bearing which is a component of the thrust bearing 147. As shown in FIGS. 23 and 24, two projections 183*b* extend from the outer peripheral surface of the washer 183 and slidably engage in associated guide grooves 106*a* of the fan housing 106. The washer 183 can move in the axial direction of the support shaft 143 via the projections 183*b*.

The engagement position selection lever 185 is rotatably fitted onto the support ring 186 and can swing on the axis of the support shaft 143. The washer 183 and the engagement position selection lever 185 are arranged in a superimposed state on each other and have end surface teeth 183*a* and 185*a*, respectively, on the mating faces in the circumferential direction. The end surface teeth 183*a* and 185*a* can be engaged with each other. The end surface teeth 183*a* of the washer 183 and the end surface teeth 185*a* of the engagement position selection lever 185 can be switched between the engaged state and the disengaged state by rotation of the washer 183 and the engagement position selection lever 185 with respect to each other. In the engaged state, the teeth of one of the washer 183 and the engagement position selection lever 185 fit between the teeth of the other of the washer 183 and the engagement position selection lever 185 (as shown in a circle in FIG. 23). In the disengaged state, the teeth of one of the washer 183 and the engagement position selection lever 185 ride on the teeth of the other of the washer 183 and the engagement position selection lever 185 (as shown in a circle in FIG. 24). FIGS. 23 and 24 are sectional views taken along line B-B in FIG. 17, and in the circles above the sectional views are shown the engaged or disengaged state of the end surface teeth 183*a*, 185*a*.

When the end surface teeth 183*a* of the washer 183 and the end surface teeth 185*a* of the engagement position selection lever 185 engage with each other, as shown in FIG. 17, the washer 183 and the engagement position selection lever 185 are superimposed on each other in close contact by the biasing force of the compression coil spring 149. At this time, the driving-side clutch member 133 and the clutch cam 137 are in the rearward position to which they are moved away from the spindle-side clutch member 135. On the other hand, when the end surface teeth 183*a* of the washer 183 and the end surface teeth 185*a* of the engagement position selection lever 185 disengage from each other, the washer 183 moves away from the engagement position selection lever 185 by the distance corresponding to the height of the end surface teeth 183*a* (see FIG. 19). This movement causes the driving-side clutch member 133 and the clutch cam 137 to be pushed (advanced) toward the spindle-side clutch member 135 against the biasing force of the compression coil spring 149. At this time, the driving-side clutch member 133 and the clutch cam 137 are in the forward position to which they are moved toward the spindle-side clutch member 135.

Thus, the engagement position changing mechanism 181 is configured such that the engagement position of the driven-side clutch teeth 135*a* with the driving-side clutch teeth 133*a* and the auxiliary clutch teeth 137*a* can be changed by changing the position of the driving-side clutch member 133 and the clutch cam 137 between the rearward position and the forward position. Further, as shown in the circles of FIGS. 23 and 24, the end surface teeth 183*a* of the washer 183 and the end surface teeth 185*a* of the engagement position selection lever 185 have an inclined surface which is inclined at such an angle as to allow smooth disengagement. Further, the engagement position selection lever 185 has a clearance hole 185*c* for avoiding interference with the output shaft 113 of the motor 111.

As shown in FIGS. 17 and 19, a rotation selection switch 187 is mounted on a portion of the motor housing 105 and serves to change the direction of rotation of the motor 111. The rotation selection switch 187 has a switch lever 189 which can be operated by rotating between the normal rotation position and the reverse rotation position. The operation force of rotating the switch lever 189 is transmitted to the engagement position selection lever 185 via a coupling mechanism 191. Specifically, the engagement position changing mechanism 181 is configured such that the change of the engagement position between the tightening mode position and the loosening mode position can be interlocked with the rotation selecting operation of the switch lever 189. The engagement position selection lever 185 and the switch lever 189 are features that correspond to the "mode selecting member" and the "rotation selecting member", respectively according to the invention.

The coupling mechanism 191 includes a lever rod 193 which extends parallel to the support shaft 143. The lever rod 193 is disposed within the motor housing 105 and the fan housing 106 and can rotate around the axis of the lever rod 193. A forked arm 193*a* is formed on one axial end of the lever rod 193 and engages with an end projection 189*a* of the switch lever 189 (see FIG. 21). An arm 193*b* is formed on the other axial end of the lever rod 193 and engages with a recess 185*b* formed on the end of the engagement position selection lever 185.

With this construction, when the switch lever 189 is rotated between the normal rotation position and the reverse rotation position, the end projection 189*a* of the switch lever 189 pushes the forked arm 193*a*, which causes the lever rod 193 to rotate. At the same time, the lever rod 193 rotates the engagement position selection lever 185 via the arm 193*b* on the other end. Specifically, when the switch lever 189 is rotated to the normal rotation position, the engagement position selection lever 185 is rotated via the lever rod 193 to a position in which the end surface teeth 185*a* engage with the end surface teeth 183*a* of the washer 183. When the switch lever 189 is rotated to the reverse rotation position, the engagement position selection lever 185 is rotated to a position in which the end surface teeth 185*a* disengage from (ride on) the end surface teeth 183*a* of the washer 183.

Operation of the clutch mechanism 131 thus constructed according to this embodiment will now be explained. When the switch lever 189 of the rotation selection switch 187 of the motor 111 is rotated to the normal rotation position in order to tighten the screw S, the engagement position selection lever 185 is rotated leftward (as viewed in FIG. 23) via the lever rod 193 by the operation force of rotating the switch lever 189. Then, the end surface teeth 185*a* of the engagement position selection lever 185 engage with the end surface teeth 183*a* of the washer 183. As a result, as mentioned above, the washer 183 and the engagement position selection lever 185 closely contact with each other. At this time, the clutch teeth 133*a*, 137*a* of the driving-side clutch member 133 and the clutch cam 137 are move to the rearward position. Thus, the engagement position between the clutch teeth 133*a*, 137*a* and the driven-side clutch teeth 135*a* of the spindle-side clutch member 135 is changed to the rearward position. Specifically, engagement of the clutch mechanism 131 is the engagement in the tightening mode. This state is shown in FIG. 17 and corresponds to the unloaded conditions shown in FIG. 3 in the first embodiment.

Thereafter, the trigger 121 is depressed, the motor is driven in the normal direction, and the screw S is set on the driver bit 119 and pressed against the workpiece W. When the driver bit 119 is pressed against the workpiece W, the spindle-side clutch member 135 is caused to retract together with the spindle 117, so that the clutch mechanism 131 engages. The operation of tightening the screw S is performed via this engagement of the clutch mechanism 131. During the operation of tightening the screw S, the clutch mechanism 131 performs a silent clutch function. The operation of the clutch mechanism 131 in the screw-tightening operation is identical to that in the tightening operation in the first embodiment, and therefore will not be described in further detail. FIG. 18 shows the instant when the clutch mechanism 131 is disengaged immediately after the screw-tightening operation has been completed. Thereafter, the driving-side clutch member 133 and the clutch cam 137 are pushed toward the thrust bearing 147 by the compression coil spring 149 and moved by the distance corresponding to the clearance C that has been created by the silent clutch operation. As a result, a clearance for avoiding interference is created between the driving-side clutch teeth 133*a* and auxiliary clutch teeth 137*a* and the driven-side clutch teeth 135*a*. Thus, the clutch mechanism 131 performs the silent clutch function.

On the other hand, when the switch lever 189 of the rotation selection switch 187 is rotated to the reverse rotation position, the engagement position selection lever 185 is rotated rightward (as viewed in FIG. 24) via the lever rod 193. Then, the end surface teeth 185*a* of the engagement position selection lever 185 disengage from the end surface teeth 183*a* of the washer 183. As a result, as shown in FIG. 19, the engagement position selection lever 185 pushes the washer 183 forward, which causes the driving-side clutch member 133 and the clutch cam 137 to move together with the washer 183 toward the spindle-side clutch member 135 against the biasing force of the compression coil spring 149. By this movement, the engagement position of the driven-side clutch teeth 135*a* with the driving-side clutch teeth 133*a* and the auxiliary clutch teeth 137*a* is changed to the forward position. Specifically, the engagement position of the clutch mechanism 131 is changed to the engagement position for the mode of loosening the screw S.

Therefore, in order to perform the operation of loosening the screw S, in this state, the trigger 121 is depressed, the motor is driven in the reverse direction, and the tip end of the driver bit 119 which protrudes from the tip end of the stopper sleeve 125 is placed on and pressed against the head of the screw S. Then, the spindle-side clutch member 135 is caused to retract together with the driver bit 119 and the spindle 117, and the driven-side clutch teeth 135*a* engage with the driving-side clutch teeth 133*a* and the auxiliary clutch teeth 137*a*. At this point, the engagement of the driven-side clutch teeth 135*a* with the driving-side clutch teeth 133*a* and the auxiliary clutch teeth 137*a* are deep enough. Therefore, the torque of the motor 11 in the reverse direction is transmitted to the driver bit 119 via the clutch mechanism 131 in the stable state. Thus, the operation of loosening the screw S can be performed.

Thus, according to this embodiment, when the motor 111 is driven in the reverse direction, the clutch mechanism 131 engages in the forward position to which the driving-side clutch member 133 and the clutch cam 137 are moved toward the spindle-side clutch member 135. With this construction, the operation of loosening the screw S can be performed with the stopper sleeve 125 left attached to the body 103. Thus, the workability can be improved.

Further, in this embodiment, the operation of selecting the direction of rotation of the motor 111 is interlocked with the operation of selecting the mode of operation of the driver bit 119. Thus, the ease of operation can be improved and the operational misidentification can be avoided.

Modification of the Second Representative Embodiment

Figure 25:
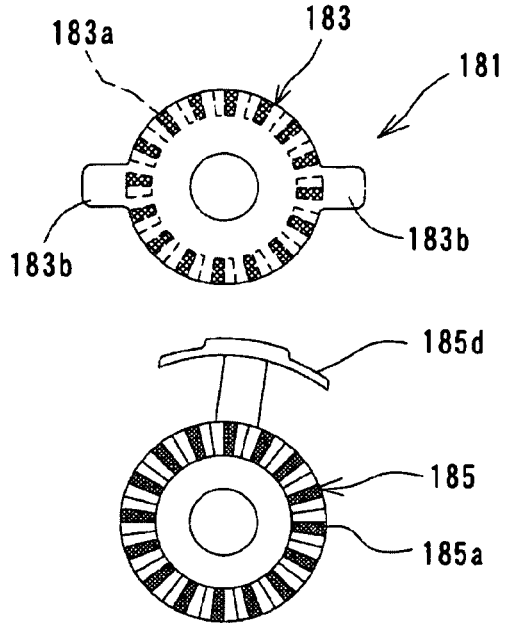
FIG. 25 shows a modification of the engagement position changing mechanism.
Figure 26:
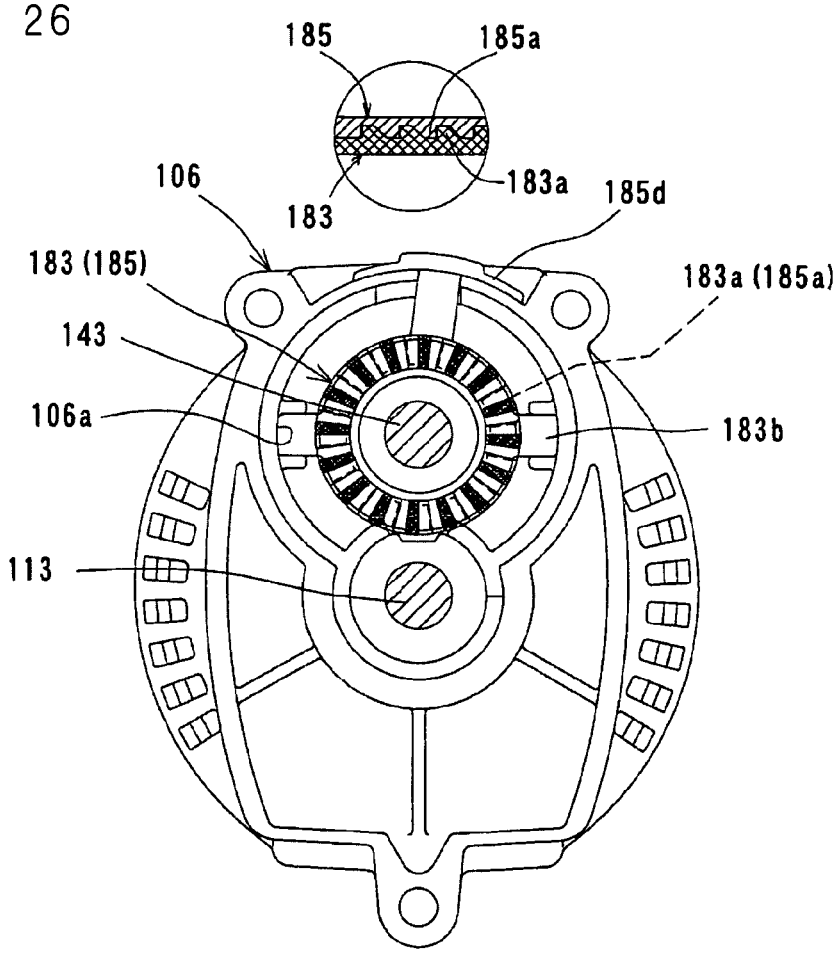
FIG. 26 shows the state in which the engagement position changing mechanism is placed in the tightening operation mode.
Figure 27:
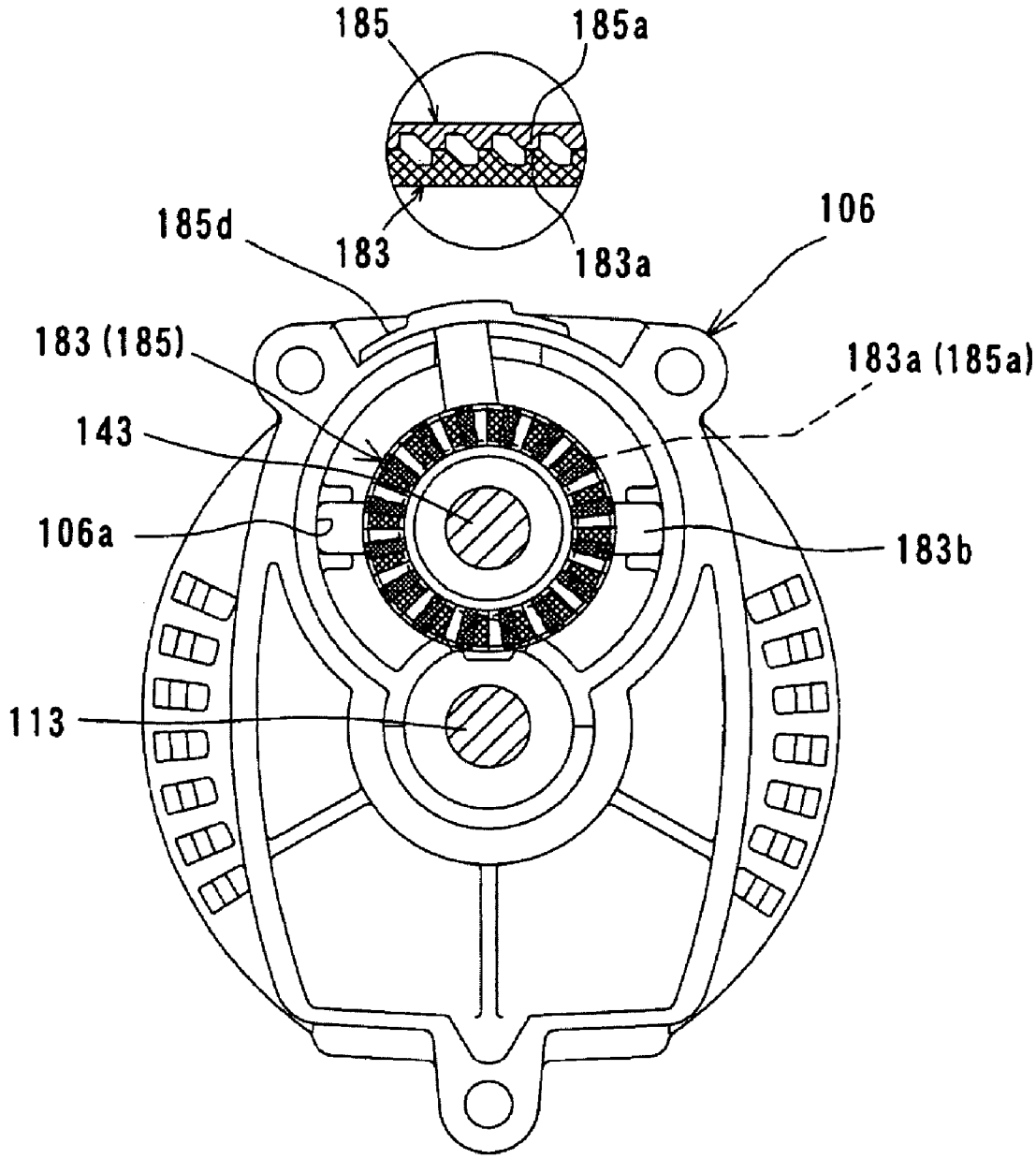
FIG. 27 shows the state in which the engagement position changing mechanism is placed in the loosening operation mode.

FIGS. 25 to 27 show a modification of the second embodiment. In this modification, the operating method of the engagement position changing mechanism 181 has been modified from the switch-coupled operation to the manual operation. Specially, in the modification, the operation of selecting the direction of rotation of the motor 111 and the operation of selecting the clutch engagement position are separately performed. This modification has an otherwise identical construction with the second embodiment.

The engagement position changing mechanism 181 includes the washer 183 and the engagement position selection lever 185 which are arranged in a superimposed state on each other. Part of the engagement position selection lever 185 extends outward through the fan housing 106 that houses the engagement position selection lever 185. A knob 185 is provided on the exposed end of the extended part of the engagement position selection lever 185. Specifically, the engagement position selection lever 185 can be operated from outside the body 103. When the engagement position selection lever 185 is rotated between the tightening operation mode position (see FIG. 26) for tightening the screw S and the loosening operation mode position (see FIG. 27) for loosening the screw S, by operating the knob 185*d*, the end surface teeth 183*a* of the washer 183 and the end surface teeth 185*a* of the engagement position selection lever 185 are engaged with or disengaged from each other. The engagement position selection lever 185 is a feature that corresponds to the "mode selecting member" in this invention.

Like in the second embodiment, the engagement of the clutch mechanism 131 is performed in the rearward position when the position selection lever 185 is rotated around the axis of the support shaft 143 to the tightening operation mode position, while the engagement of the clutch mechanism 131 is performed in the forward position when the position selection lever 185 is rotated to the loosening operation mode position. Therefore, according to this modification, the same effect can be obtained as in the second embodiment except for the point that it is not a switch-coupled operation In the second embodiment and the above-mentioned modification, in the loosening operation mode, the spindle-side clutch member 135 is retracted together with the driver bit 119 and the spindle 117 after the driving-side clutch teeth 133*a* and the auxiliary clutch teeth 137*a* are moved to the forward position, so that the driven-side clutch teeth 135*a* engage with the driving-side clutch teeth 133*a* and the auxiliary clutch teeth 137*a*. However, it may be constructed such that the driven-side clutch teeth 135*a* engage with the driving-side clutch teeth 133*a* and the auxiliary clutch teeth 137*a* via the movement of the driving-side clutch teeth 133*a* and the auxiliary clutch teeth 137*a* to the forward position. This construction can be readily realized by further increasing the amount of axial movement of the washer 183 with respect to the engagement position selection lever 185, or by increasing the height of the end surface teeth 183*a*.

Further, in the above embodiments, the electric screwdriver 101 for tightening the screw S has been described as a representative example of the "tightening tool" according to the present invention. However, the present invention is not limited to the screwdriver 101, but may be applied to any tightening tool in which the torque of the driving motor 111 is transmitted to the tool bit via the clutch mechanism. Further, although, in the above embodiments, the driving-side clutch member 133 is disposed on the outer side and the clutch cam 137 is disposed on the inner side, they may be disposed vice versa. In the above embodiments, the engagement speedup mechanism 161 has been described as being disposed between the spindle 117 and the spindle-side clutch member 135. However, it may be constructed without the engagement speedup mechanism 161. In this case, the spindle 117 and the spindle-side clutch member 135 may be formed into one piece.

The engagement position selection lever 185 may be manually operated at a position outside of the rotating radius of the end surface teeth 183*a*, 185*a* such that the lever 185 functions as a cantilever. The engagement position selection lever 185 may extend to cross the longitudinal axis of the driving-side clutch member 133. Further, the extending direction of the engagement position selection lever 185 may preferably coincides with the longitudinal direction of the body 103 in the cross-section of the body 103 in order to utilize inner space of the body 103. Further, the engagement position selection lever 185 may be operated in the circumferential direction by utilizing a linkage defined by the arm 193*b*. By such construction, rotating width of the tip end of the engagement position selection lever 185 during its operation can be minimized and does not adversely affect the space design of the body 103.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of values ranges.

DESCRIPTION OF NUMERALS

101 electric screwdriver (tightening tool)
103 body
105 motor housing
106*a* guide groove
107 clutch housing
109 handgrip
111 driving motor (motor)
113 output shaft
115 pinion gear
117 spindle
117*a* flange
119 driver bit (tool bit)
121 trigger
123 adjuster sleeve
125 stopper sleeve
127 stopper ring
131 clutch mechanism
133 driving-side clutch member (driving-side clutch element)
133*a* driving-side clutch teeth
133*b* circular recess (recess)
133*c* rear surface
134 driving gear
135 spindle-side clutch member (driven-side clutch element)
135*a* driven-side clutch teeth
137 clutch cam (auxiliary clutch)
137*a* auxiliary clutch teeth
141 bearing
143 support shaft
145 bearing
147 thrust bearing
149 compression spring (elastic element)
151 steel ball (axial displacement means)
153 lead groove
153*a* groove bottom
155 cam face
161 engagement speedup mechanism
162 steel ball
163 cylindrical portion
164 through hole
165 engagement recess
165*a* inclined surface
166 stepped portion
166*a* inclined surface
167 small-diameter portion
168 a large-diameter portion
171 driving-side end surface cam portion (inclined surface portion)
173 driven-side end surface cam portion (inclined surface portion)
171*a*, 173*a* inclined surface
171*b*, 173*b* flat engagement position holding surface
171*c*, 173*c* flat disengagement position holding surface
171*d*, 173*d* projection
171*e*, 173*e* corner
181 engagement position changing mechanism
183 washer
183*a* end surface teeth
183*b* projection
185 engagement position selection lever (mode selecting member)
185*a* end surface teeth
185*b* recess
185*c* clearance hole
185*d* knob
186 support ring
187 rotation selection switch
189 switch lever (rotation selecting member)
189*a* end projection
191 coupling mechanism
193 lever rod
193*a* forked arm
193*b* arm

What we claim is:

1. A tightening tool comprising:

a body, a driving motor housed in the body, the driving motor configured to rotate in a normal rotation and a reverse rotation, a driving-side clutch element configured to receive torque of the driving motor both in the normal rotation and in the reverse rotation, an auxiliary clutch element rotated by the driving-side clutch element by the interaction of cam surfaces on the auxiliary clutch element, the cam surfaces on the auxiliary clutch element including first inclined surfaces, first projecting surfaces and first flat holding surfaces for interacting with second inclined surfaces, second projecting surfaces and second flat holding surfaces of the driving-side clutch element such that the auxiliary clutch element is movably provided in the axial direction away from the driving-side clutch element during reverse rotation of the driving-side clutch element, wherein the auxiliary clutch element and the driving-side clutch element are prevented from moving in the circumferential direction with respect to each other by contact between the first and second projecting surfaces, a driven-side clutch element configured to directly releasably engage with both the driving-side clutch element and the auxiliary clutch element so as to receive the torque of the driving-side clutch element to rotate in the normal rotation and directly releasably engage with only the auxiliary clutch element in the reverse rotation, a driven shaft configured to be driven by rotation of the driving-side clutch element, and a tool bit connected to the driven shaft to perform a tightening operation and a loosening operation via rotating torque of the driven shaft, wherein:

the driven shaft configured to move in the axial direction with respect to the body together with the driving-side clutch element, during normal rotation of the driving motor, the driven-side clutch element is configured to move in the axial direction by application of a pressing force of the user to the body to engage with the driving-side clutch element, so that the torque of the driving motor in the normal direction is transmitted to the tool bit to perform a tightening operation, and during reverse rotation of the driving motor, the driving-side clutch element and the auxiliary clutch element are configured to move relatively with respect to each other in the axial direction by rotating torque of the driving-side clutch element, and the driving-side clutch element or the auxiliary clutch element is configured to engage with the driven-side clutch element, so that the torque of the driving motor in the reverse direction is transmitted to the tool bit to perform a loosening operation, whereby the engagement of the driven-side clutch element with the driving-side clutch element or the auxiliary clutch element is configured to occur without movement of the driven-side clutch element in the axial direction relative to the body.

2. The tightening tool as defined in claim 1, further comprising a support shaft rotated by the driving motor, wherein the driving-side clutch element and the auxiliary clutch element are coaxially disposed on the support shaft at the same region in the longitudinal direction of the support shaft such that one of the driving-side clutch element and the auxiliary clutch element forms outer ring and the other forms inner ring.

3. The tightening tool as defined in claim 1, wherein at least one of the driving-side clutch element and the driven-side clutch element includes an inclined surface disposed thereon, and wherein, during reverse rotation of the driving motor, the axial relative movement of the driving-side clutch element and the auxiliary clutch element is caused by movement of the driving side clutch element and the driven-side clutch element with respect to each other via the inclined surface within a predetermined range in the circumferential direction, and wherein said axial movement causes the driving-side clutch element or the auxiliary clutch element to engage with the driven-side clutch element and said engagement is maintained in a position in which said relative movement in the circumferential direction is prevented.

4. The tightening tool as defined in claim 1, wherein the driving-side clutch element can move in the axial direction with respect to the body, and the driven shaft can move in the axial direction with respect to the body together with the driving-side clutch element, the tightening tool further comprising a mode selecting member between tightening mode and loosening mode of operation of the tool bit, wherein:

when the mode selecting member is operated to select the tightening mode, the driven-side clutch element is caused to move in the axial direction by application of a pressing force of the user to the body to engage with the driving-side clutch element, so that the torque of the driving motor in the normal direction is transmitted to the tool bit to perform a tightening operation, and when the mode selecting member is operated to select the loosening mode, the driving-side clutch element is caused to move toward the driven-side clutch element by operation force of the mode selecting member for selecting the loosening mode and engage with the driven-side clutch element by said movement toward the driven-side clutch element or by subsequent application of a pressing force of the user to the body to deeply engage the driving-side clutch element or the auxiliary clutch element with the driven-side clutch element, so that the torque of the driving motor in the reverse direction is transmitted to the tool bit to perform a loosening operation.

5. The tightening tool as defined in claim 4, further comprising a rotation selecting member that selects the direction of rotation of the driving motor between normal and reverse directions, wherein the mode selecting member and the rotation selecting member are coupled to each other such that the mode selecting member selects the tightening mode when the rotation selecting member select the normal direction, while the mode selecting member selects the loosening mode when the rotation selecting member select the reverse direction.

6. The tightening tool as defined in claim 4, wherein the mode selecting member comprises an engagement position selection lever, a washer being overlapped with the engagement position selection lever and a pair of end surface teeth respectively provided on the engagement surface of the engagement position selection lever and the washer, the engagement position selection lever and the washer being capable of relatively rotating to each other in a circumferential direction, wherein the washer is caused to move via a disengagement of the pair of end surface teeth of the engagement position selection lever and the washer when the engagement position selection lever is rotated in a circumferential direction, and the driving-side clutch element is caused to move toward the driven-side clutch element according to the movement of the washer.

7. The tightening tool as defined in claim 6, wherein the engagement position selection lever comprises an lever operating portion to rotate the lever in a circumferential direction, the lever operating portion being disposed outside of the rotating radius of the end surface teeth.

8. The tightening tool as defined in claim 6, wherein the engagement position selection lever extends to cross the longitudinal axis of the driving-side clutch element, the extending direction of the engagement position selection lever coincides with the longitudinal direction of the body in the cross-section of the body.

9. The tightening tool as defined in claim 6, further comprising a linkage, wherein the engagement position selection lever is operated in the circumferential direction by means of the linkage.

10. The tightening tool as defined in claim 1, whereby during normal rotation of the driving motor the driven-side clutch element engages the driving-side clutch element and the auxiliary clutch element.

11. The tightening tool as defined in claim 1, whereby during reverse rotation of the driving motor, the driven-side clutch element engages the auxiliary clutch element before engaging the driving-side clutch element.

* * * * *